US008056361B2

(12) United States Patent
Matsui et al.

(10) Patent No.: US 8,056,361 B2
(45) Date of Patent: Nov. 15, 2011

(54) MULTI-STAGE ROTARY-TYPE FLUID MACHINE AND REFRIGERATION CYCLE APPARATUS

(75) Inventors: Masaru Matsui, Kyoto (JP); Hiroshi Hasegawa, Osaka (JP); Atsuo Okaichi, Osaka (JP); Takeshi Ogata, Osaka (JP); Masanobu Wada, Osaka (JP); Yasufumi Takahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 502 days.

(21) Appl. No.: 12/438,395

(22) PCT Filed: Aug. 6, 2007

(86) PCT No.: PCT/JP2007/065374

§ 371 (c)(1),
(2), (4) Date: Feb. 23, 2009

(87) PCT Pub. No.: WO2008/026428

PCT Pub. Date: Mar. 6, 2008

(65) Prior Publication Data

US 2010/0242531 A1 Sep. 30, 2010

(30) Foreign Application Priority Data

Aug. 29, 2006 (JP) ..... 2006-232782

(51) Int. Cl.

| | |
|---|---|
| ***F25B 1/00*** | (2006.01) |
| ***F01C 1/02*** | (2006.01) |
| ***F03C 2/00*** | (2006.01) |

(52) U.S. Cl. ..... 62/498; 418/58; 418/60

(58) Field of Classification Search ..... 62/498; 418/13, 60, 63, 3, 58

See application file for complete search history.

(56) References Cited

U.S. PATENT DOCUMENTS

| | | | |
|---|---|---|---|
| 5,322,424 | A | 6/1994 | Fujio |
| 2007/0053782 | A1 | 3/2007 | Okamoto et al. |

FOREIGN PATENT DOCUMENTS

| | | | |
|---|---|---|---|
| EP | 1 739 369 | A1 | 1/2007 |
| JP | 2005-106046 | A | 4/2005 |
| JP | 2005-265278 | A | 9/2005 |
| JP | 2006-118438 | A | 5/2006 |

*Primary Examiner* — Chen Wen Jiang

(74) *Attorney, Agent, or Firm* — Hamre, Schumann, Mueller & Larson, P.C.

(57) ABSTRACT

A multi-stage rotary-type fluid machine may be configured as what is called a two-stage rotary expander, in which a refrigerant expands in an expansion chamber having a first discharge side space (115*b*) of a first cylinder (105), a second suction side space (116*a*) of a second cylinder (106), and a communication hole (104*a*) for allowing communication between the two spaces (115*b*, 116*a*). The first cylinder (105) and the second cylinder (106) are partitioned by an intermediate plate (104). The communication hole (104*a*) is formed so as to penetrate through the intermediate plate (104). The opening shape and location of the communication hole (104*a*) are set so that direct blow-through of the refrigerant from a suction port (105*b*) to a discharge port (106*b*) cannot occur at any rotation angle of a shaft (103).

12 Claims, 29 Drawing Sheets

MULTI-STAGE ROTARY-TYPE FLUID MACHINE AND REFRIGERATION CYCLE APPARATUS

TECHNICAL FIELD

The present invention relates to a multi-stage rotary-type fluid machine such as represented by a compressor or an expander. The invention also relates to a refrigeration cycle apparatus that uses the multi-stage rotary-type fluid machine.

BACKGROUND ART

A power recovery type refrigeration cycle apparatus in which the energy of expansion of refrigerant is recovered by an expander and the recovered energy is utilized as a part of the work of a compressor has been proposed. For example, a two-stage rotary expander such as disclosed in JP 2005-106046A has been studied as an expander used for such a refrigeration cycle apparatus.

FIGS. 10A and 10B are horizontal cross-sectional views of a conventional two-stage rotary expander 200. FIG. 10A shows a first stage cylinder 205 (first cylinder 205) and FIG. 10B shows a second stage cylinder 206 (second cylinder 206). The refrigerant drawn into the first cylinder 205 expands in an expansion chamber, which is constituted by a working chamber 215*b* of the first cylinder 205, a working chamber 216*a* of the second cylinder 206, and a communication hole 204*a* for allowing communication between the two working chambers 215*b* and 216*a*. The first cylinder 205 and the second cylinder 206 are partitioned vertically by an intermediate plate, and the communication hole 204*a* is formed so as to penetrate through this intermediate plate across its thickness direction. Employing such a construction makes it possible to partition the working chamber 215*a* for drawing refrigerant, the working chambers 215*b* and 216*a* for expanding the refrigerant, and the working chamber 216*b* for discharging the refrigerant easily. At the same time, it allows the suction-side working chamber 215*a* to perform 360° continuous suction, making it possible to reduce suction pulsing.

DISCLOSURE OF THE INVENTION

In the two-stage rotary expander 200 as described above, the opening shape of the communication hole 204*a* is usually circular. Hereinbelow, the workings of the communication hole 204*a* will be described with reference to the operation explanatory views of FIGS. 11A to 11D. FIGS. 11A to 11D illustrate, in chronological order, how the communication hole 204*a* communicates with the working chambers 215*a*, 215*b*, 216*a*, and 216*b* when a shaft 203 (see FIGS. 10A and 10B) rotates anticlockwise. In each of the figures, the upper view corresponds to the first cylinder 205 side and the lower view corresponds to the second cylinder 206 side. The portion in which the communication hole 204*a* communicates with the working chambers 215*a*, 215*b*, 216*a*, and 216*b* is hatched with diagonal lines.

FIG. 11A illustrates the moment at which the working chamber 215*a* of the first cylinder 205 and the communication hole 204*a* start communication therebetween. The communication between the communication hole 204*a* and the working chamber 215*a* of the first cylinder 205 starts by gradual opening of the communication hole 204*a* from its closed state in association with rotation of the shaft 203. According to the example of FIG. 11A, the moment at which the working chamber 215*a* of the first cylinder 205 and the communication hole 204*a* start communication therebetween is the moment at which a contact point Q1 between the opening edge of the communication hole 204*a* and the inner circumferential surface of the first cylinder 205 matches a contact point P1 between a first piston 209 and the first cylinder 205. At this moment, the communication hole 204*a*, the working chamber 216*a*, and a discharge port 206*b* are in communication with each other in the second cylinder 206 side.

FIG. 11B illustrates the moment at which both the first piston 209 and a second piston 210 are at the top dead center, i.e., the moment at which a first vane 211 and a second vane 212 are compressed most. Only at this moment in time, neither the working chamber of the first cylinder 205 nor that of the second cylinder 206 is partitioned into two chambers. The communication hole 204*a* is in communication with the working chamber 215 of the first cylinder 205 (215*a*+215*b*) and the working chamber 216 of the second cylinder 206 (216*a*+216*b*). However, when observed carefully, the working chamber 215 of the first cylinder 205 is also in communication with a suction port 205*b*, and moreover, the working chamber 216 of the second cylinder 206 is also in communication with the discharge port 206*b*. That is, the refrigerant drawn from the suction port 205*b* can blow through the working chamber 215 of the first cylinder 205, the communication hole 204*a*, and the working chamber 216 of the second cylinder 206 in that order, so as to blow into the discharge port 206*b* directly.

Next, when the shaft 203 rotates to the state shown in FIG. 11C, communication between the communication hole 204*a* and the working chambers 216*a*, 216*b* of the second cylinder 206 finishes for the time being. According to the example of FIG. 11C, the moment at which the working chamber 216*a* of the second cylinder 206 and the communication hole 204*a* start communication therebetween is the moment at which a contact point Q2 between the opening edge of the communication hole 204*a* and the inner circumferential surface of the second cylinder 206 matches a contact point P2 between the second piston 210 and the second cylinder 206.

FIG. 11D illustrates the state in which the shaft 203 has rotated 20° from FIG. 11C. The expansion chamber is constituted by the working chamber 215*b* of the first cylinder 205, the working chamber 216*a* of the second cylinder 206, and the communication hole 204*a* for allowing communication between the two working chambers 215*b* and 216*a*.

In this type of two-stage rotary expander, as described above, there may be a phenomenon in which the refrigerant may blow from a suction port to a discharge port directly before and after the communication hole 204*a* opens/closes. This phenomenon may continue through the period from the state shown in FIG. 11A to the state shown in FIG. 11C and may degrade performance of the expander.

In addition, another problem will be discussed below.

FIG. 11B illustrates the moment at which the pistons 209 and 210 are at the top dead center. Only at this moment in time, neither the working chamber of the first cylinder 205 nor that of the second cylinder 206 is partitioned into two chambers. Then, as the vanes 211 and 212 start to advance in accordance with rotation of the shaft 203, the working chambers 215*a* and 216*a* start to form anew (see FIGS. 11C and 11D).

However, no refrigerant is supplied from the communication hole 204*a* to the newly-formed working chamber 216*a* during the period from the state shown in FIG. 11B to the state shown in FIG. 11C. That is, the volume of the working chamber 216*a* of the second cylinder 206 is increased forcibly while no refrigerant is being supplied thereto. As a consequence, a brake torque can be generated in an opposite direction to the direction of rotation of the shaft 203.

This problem may arise not only with the two-stage rotary expander but also with other types of multi-stage rotary-type fluid machines, such as two-stage rotary compressors.

In view of the foregoing problems, it is an object of the present invention to provide a highly efficient multi-stage rotary-type fluid machine that prevents the phenomenon in which a working fluid (e.g., refrigerant) drawn from a suction port is blown through to a discharge port without doing any work. Also, it is an object of the invention to minimize the generation of the brake torque (make the period in which the brake torque is generated as short as possible).

Accordingly, the present invention provides a multi-stage rotary-type fluid machine including:

a first cylinder;

a shaft penetrating the first cylinder;

a first piston fitted to the shaft and rotating eccentrically in the first cylinder;

a second cylinder disposed concentrically with the first cylinder so as to share the shaft with the first cylinder;

a second piston fitted to the shaft and rotating eccentrically in the second cylinder;

a first partitioning member fitted into a first groove formed in the first cylinder, for partitioning a space between the first cylinder and the first piston into a first suction side space and a first discharge side space;

a second partitioning member fitted into a second groove formed in the second cylinder, for partitioning a space between the second cylinder and the second piston into a second suction side space and a second discharge side space;

an intermediate plate having a communication hole for allowing communication between the first discharge side space and the second suction side space to form a single working chamber, the intermediate plate partitioning the first cylinder and the second cylinder;

a suction port for drawing a working fluid into the first suction side space; and a discharge port for discharging the working fluid from the second discharge side space, wherein an opening shape and a location of the communication hole are set so that direct blow-through of the working fluid from the suction port to the discharge port cannot occur at any rotation angle of the shaft.

The present invention also provides a refrigeration cycle apparatus including:

a compressor for compressing a refrigerant;

a radiator for cooling the refrigerant compressed by the compressor;

an expander for expanding the refrigerant cooled by the radiator; and an evaporator for evaporating the refrigerant expanded by the expander, wherein the expander is constituted by the multi-stage rotary-type fluid machine.

The present invention prevents the phenomenon in which the refrigerant directly blows through from the suction port to the discharge port, making it possible to provide a highly efficient multi-stage rotary-type fluid machine. When the multi-stage rotary-type fluid machine according to the present invention is used as an expander of a refrigeration cycle apparatus, the energy of expansion of the refrigerant can be recovered fully, so the effect of improving the coefficient of performance can be expected.

BEST MODE FOR CARRYING OUT THE INVENTION

Hereinbelow, embodiments of the present invention is described with reference to the appended drawings. The rotary-type fluid machine, such as represented by a rotary-type expander and a rotary-type compressor, is categorized as a rolling piston type and a swing type, but the present invention is applicable to either of the types. The present description explains embodiments of the rolling piston type.

First Embodiment

Figure 1:
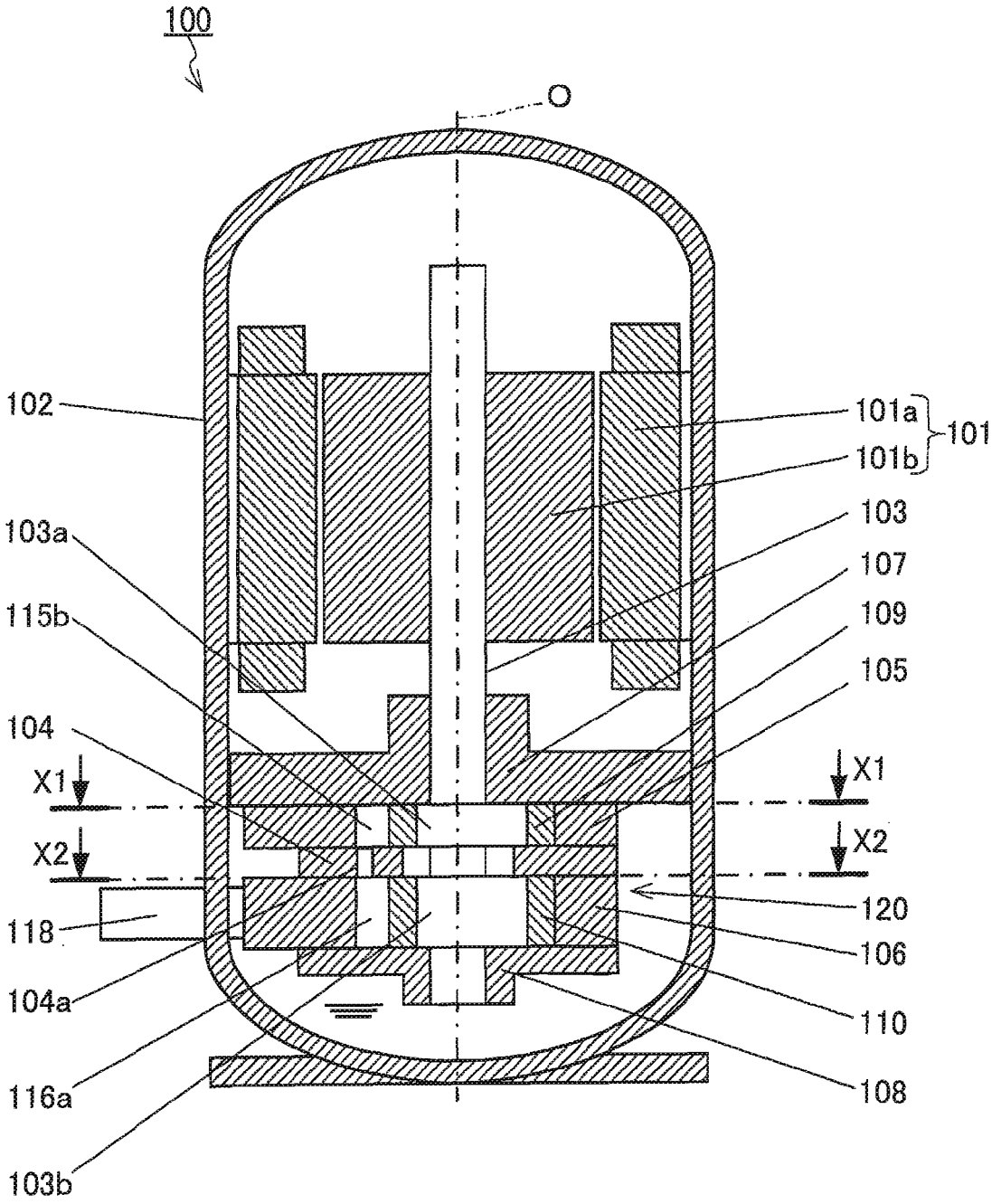
FIG. 1 is a vertical cross-sectional view of a two-stage rotary expander according to one embodiment of the present invention.
Figure 2A:
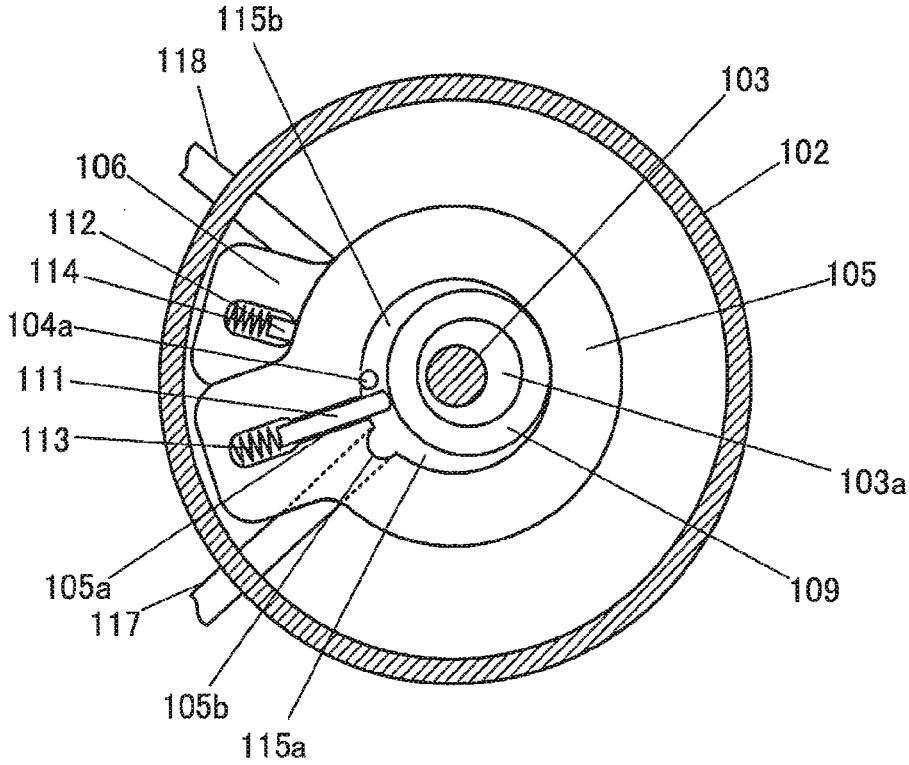
FIG. 2A is a horizontal cross-sectional view of the two-stage rotary expander shown in FIG. 1, taken along line X1-X1.
Figure 2B:
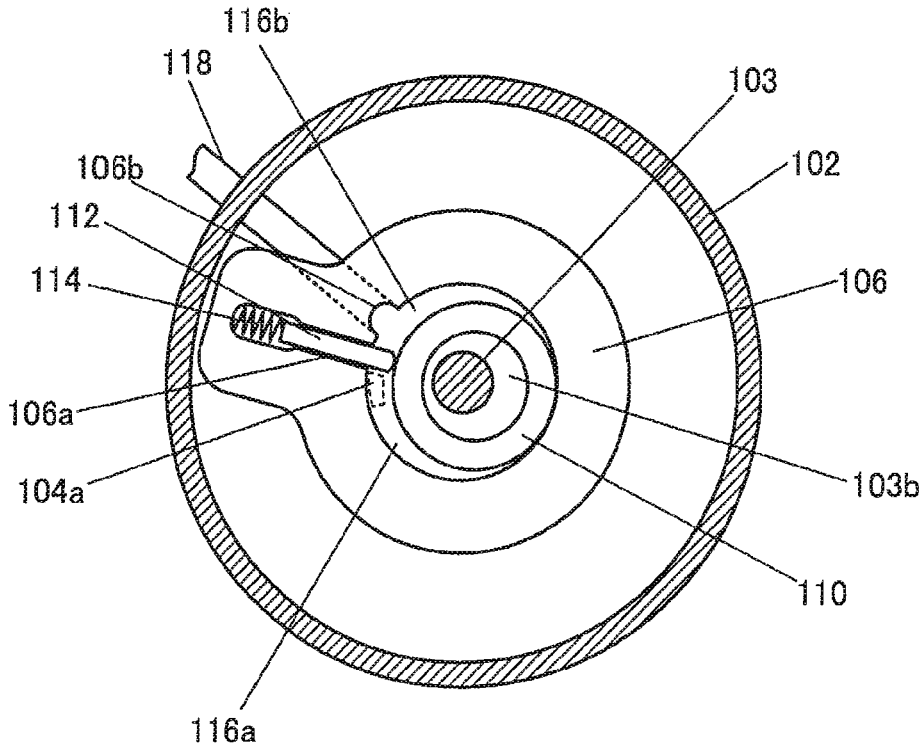
FIG. 2B is a horizontal cross-sectional view of the two-stage rotary expander shown in FIG. 1, taken along line X2-X2.

FIG. 1 is a vertical cross-sectional view illustrating the configuration of a two-stage rotary expander that is one embodiment of the present invention. FIG. 2A is a horizontal cross-sectional view of the two-stage rotary expander shown in FIG. 1, taken along line X1-X1, and FIG. 2B is a horizontal cross-sectional view thereof taken along line X2-X2. A two-stage rotary expander 100 has a closed casing 102, a power generator 101, and an expansion mechanism 120.

The power generator 101 includes a stator 101*a* fixed to the closed casing 102 and a rotor 101*b* fixed to a shaft 103. The shaft 103 is shared by the power generator 101 and the expansion mechanism 120.

The expansion mechanism 120 has an upper bearing member 107, a first cylinder 105, an intermediate plate 104, a second cylinder 106, a lower bearing member 108, a first piston 109, a second piston 110, a first vane 111, a second vane 112, a first spring 113, a second spring 114, and the shaft 103. The expansion mechanism 120 is configured as what is called the two-stage rotary type. The shaft 103 penetrates through the first cylinder 105 and the second cylinder 106, which are separated from each other by the intermediate plate 104. The shaft 103 is supported rotatably by the upper bearing member 107 and the lower bearing member 108. The shaft 103 has a first eccentric portion 103*a* and a second eccentric portion 103*b* so as to protrude radially outwardly. The first piston 109 in a ring shape, which is disposed in the first cylinder 105, is fitted to the first eccentric portion 103*a*. The second piston 110, which is disposed in the second cylinder 106, is fitted to the second eccentric portion 103*b*.

As illustrated in FIG. 2A, a first vane groove 105*a* is formed in the first cylinder 105. The first vane 111 is fitted in the first vane groove 105*a* slidably, in other words, in such a manner that it can move back and forth in longitudinal directions. The first spring 113 is disposed at the rear side of the first vane 111. One end thereof is in contact with the first cylinder 105 and the other end thereof is in contact with the first vane 111, so as to press the first vane 111 against the first piston 109. In addition, as illustrated in FIG. 2B, a second vane groove 106*a* is formed in the second cylinder 106. The second vane 112 is fitted in the second vane groove 106*a* slidably, in other words, in such a manner that it can move back and forth in longitudinal directions. The second spring 114 is disposed at the rear side of the second vane 112. One end thereof is in contact with the second cylinder 106 and the other end thereof is in contact with the second vane 112, so as to press the second vane 112 against the second piston 110.

In the case of a swing type machine, although it is also a rotary-type machine, the vanes 111, 112 and the pistons 109, 110 are constructed as unitary components, and the portions corresponding to the vanes 111, 112 swing back and forth, left and right, together with the portions corresponding to the pistons 109, 110.

A crescent-shaped space formed by the first cylinder 105 and the first piston 109 is partitioned into a first suction side space 115*a*, which is a suction side working chamber, and a first discharge side space 115*b*, which is a discharge side working chamber, by the first vane 111 serving as a partitioning member. A crescent-shaped space formed by the second cylinder 106 and the second piston 110 is partitioned into a second suction side space 116*a*, which is a suction side working chamber, and a second discharge side space 116*b*, which is a discharge side working chamber, by the second vane 112 serving as a partitioning member.

A suction port 105*b* formed in the first cylinder 105 is in communication with the first suction side space 115*a*. A suction pipe 117 penetrating through the closed casing 102 is connected to the suction port 105*b*. A communication hole 104*a* is formed in the intermediate plate 104 in such a manner that it penetrates through the intermediate plate 104 in a thickness direction. The communication hole 104*a* allows communication between the first discharge side space 115*b* of the first cylinder 105 and the second suction side space 116*a* of the second cylinder 106, so as to form a single working chamber (expansion chamber). A discharge port 106*b* formed in the second cylinder 106 is in communication with the second discharge side space 116*b*. A discharge pipe 118 penetrating through the closed casing 102 is connected to the discharge port 106*b*.

It should be noted that the suction port 105*b* may be formed in a member that is located opposite the intermediate plate 104 so as to close the first cylinder 105 (i.e., the upper bearing member 107 in the case of the present embodiment). Likewise, the discharge port 106*b* may be formed in a member that is located opposite the intermediate plate 104 so as to close the second cylinder 106 (i.e., the lower bearing member 108 in the case of the present embodiment).

In the two-stage rotary expander 100 of the present embodiment, the first cylinder 105 and the second cylinder 106 have the same inner diameter, and the first piston 109 and the second piston 110 have the same outer diameter, but the first cylinder 105 and the second cylinder 106 have different heights. Accordingly, the total volume of the second suction side space 116*a* and the second discharge side space 116*b* is greater than the total volume of the first suction side space 115*a* and the first discharge side space 115*b*, so the second cylinder 106 side has a greater displacement than the first cylinder 105 side. It should be noted, however, that, as long as the displacement size relationship is appropriate as in the present embodiment, at least one of the inner diameters of the cylinders, the heights of the cylinders, and the outer diameters of the pistons may be different from each other.

The first cylinder 105 and the second cylinder 106 are disposed concentrically with each other, but the first vane 111 and the second vane 112 are disposed to be staggered at a predetermined angle from each other around the rotation axis O of the shaft 103. The angle formed by the first vane 111 and the second vane 112 may be an acute angle of, for example, a few tens of degrees. In addition, the first eccentric portion 103*a* and the second eccentric portion 103*b* of the shaft 103 protrude in different directions (in different eccentric directions) around the rotation axis O of the shaft 103. This difference in protruding directions is in agreement with the angle θ (see FIG. 3B) formed by the first vane 111 and the second vane 112. Specifically, the time at which the first piston 109 reaches the top dead center (i.e., the position at which it presses the first vane 111 furthest) matches the time at which the second piston 110 reaches the top dead center (i.e., the position at which it presses the first vane 112 furthest). With such a configuration, the volume of the expansion chamber formed by the first discharge side space 115*b* of the first cylinder 105 and the second suction side space 116*a* of the second cylinder 106 can be increased smoothly, and the recovered power by the expander 100 is maximized. Note that in the present specification, the time at which a piston reaches the top dead center may also be referred to as "the top dead center time of the piston".

In addition, the communication hole 104*a* is formed in the intermediate plate 104 so that it extends from the first cylinder 105 toward the second cylinder 106 within an angular range between the first vane 111 and the second vane 112. With such a configuration, the length of the communication hole 104*a* with respect to the direction parallel to the rotation axis O of the shaft 103 (the axis direction) can be minimized, so that the pressure loss at the time when the refrigerant passes through the communication hole 104*a* can be reduced.

Next, the operation of the expander 100 will be described.

A high pressure refrigerant is drawn from the suction pipe 117 shown in FIG. 2A via the suction port 105*b* into the first suction side space 115*a* of the first cylinder 105. As the shaft 103 rotates, the volumetric capacity of the first suction side space 115*a* increases. When the shaft 103 rotates further, the first suction side space 115*a* changes into the first discharge side space 115*b*, and a suction stroke is completed. The high pressure refrigerant moves from the first discharge side space 115*b* of the first cylinder 105 to the second suction side space 116*a* of the second cylinder 106 through the communication hole 104*a*. Accordingly, the shaft 103 rotates in a direction in which the volumetric capacity of the entire expansion chamber formed by the first discharge side space 115*b*, the communication hole 104*a*, and the second suction side space 116*a* increases, in other words, in a direction in which the volumetric capacity of the first discharge side space 115*b* of the first cylinder 105 decreases but the volumetric capacity of the second suction side space 116*a* of the second cylinder 106 increases, whereby the power generator 101 is driven. As the shaft 103 rotates, the first discharge side space 115*b* of the first cylinder 105 disappears. The second suction side space 116*a* of the second cylinder 106 changes into the second discharge working chamber 116*b*, which is in communication with the discharge port 106*b*, and an expansion stroke completes. Then, the refrigerant, the pressure of which has been lowered, is discharged from the discharge port 106*b* to the discharge pipe 118.

As illustrated in FIG. 2A, in the first cylinder 105 side, the location of the opening of the communication hole 104*a* and the location of the suction port 105*b* are set in such a manner that they are distributed to the left and right of the first vane 111. Likewise, in the second cylinder 106 side, the location of the opening of the communication hole 104*a* and the location of the discharge port 106*b* are set in such a manner that they are distributed to the left and right of the second vane 112. This hinders a space that cannot be used as an expansion chamber from forming in the cylinders 105 and 106, making it possible to ensure a large volumetric capacity of the expansion chamber.

In the present embodiment, the refrigerant guided through the suction pipe 117 to the expansion mechanism 120 can be drawn into the first suction side space 115*a* at any rotation angle of the shaft 103 because the suction port 105*b* is not provided with a valve. In addition, the refrigerant expanded by the expansion mechanism 120 can be discharged from the second discharge side space 116*b* to the discharge pipe 118 through the discharge port 106*b* at any rotation angle of the shaft 103, because the discharge port 106*b* is not provided with a valve either. By enabling 360° continuous suction and 360° continuous discharge in this way, it is possible to suppress suction pulsing and discharge pulsing, which may be the causes of noise and vibration.

In the case of the conventional two-stage rotary expander, there may be a period in which the refrigerant does not expand at all and the refrigerant can blow through from the suction port to the discharge port, as discussed referring to FIGS. 11A to 11D, although 360° continuous suction and 360° continuous discharge are possible with the conventional two-stage rotary expander. In contrast, in the two-stage rotary expander 100 of the present embodiment, the opening shape (including the size) and location of the communication hole 104*a* are set so that such a blow-through phenomenon cannot occur at any rotation angle of the shaft 103. Hereinbelow, a description is given with reference to FIGS. 3A to 3D. FIGS. 3A to 3D are operation explanatory views similar to FIGS. 11A to 11D that are discussed previously.

Figure 3A:
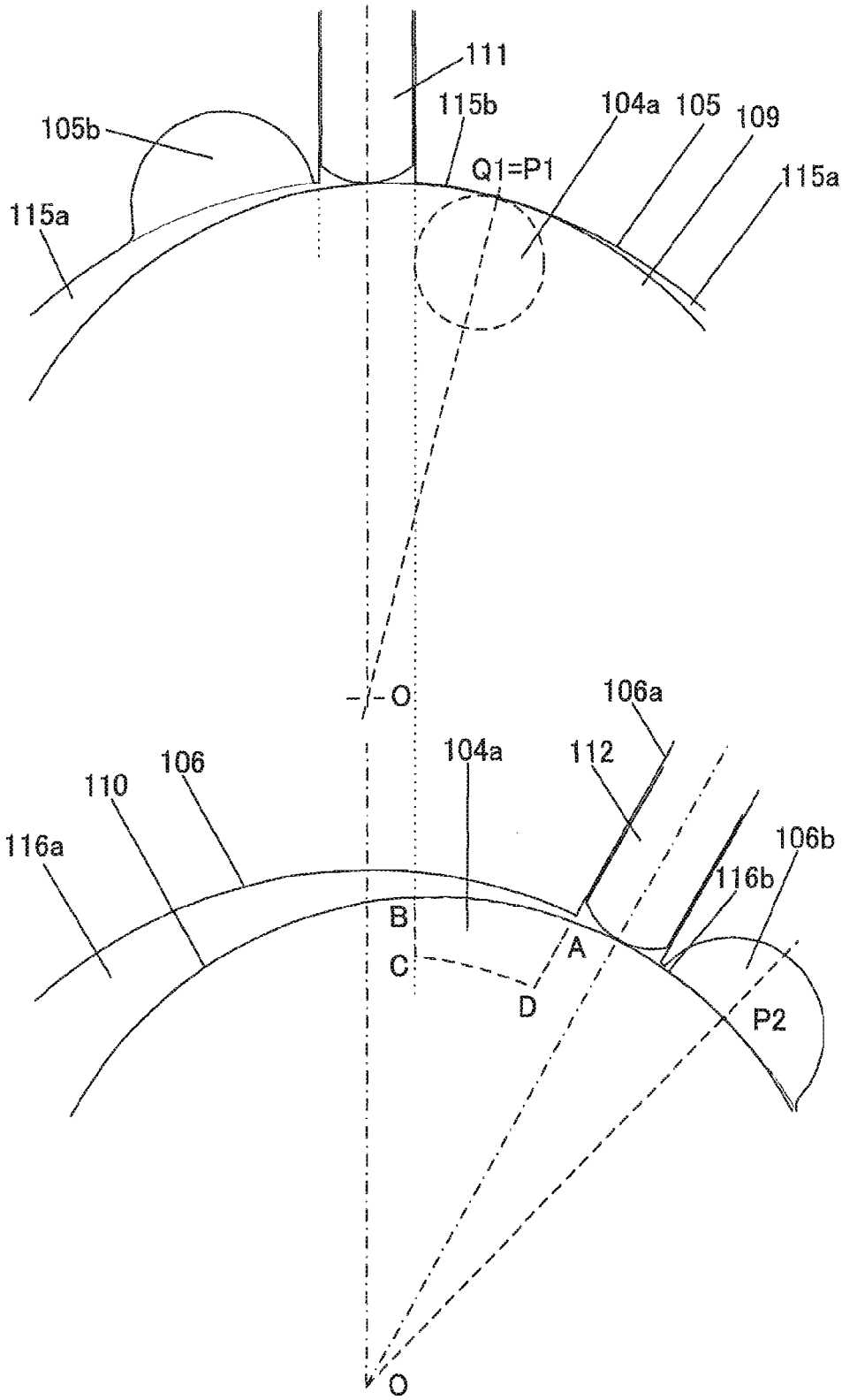
FIG. 3A is an operation explanatory view illustrating how a communication hole and a working chamber are allowed to communicate with each other in a first embodiment.

FIG. 3A illustrates the moment at which the first suction side space 115*a* of the first cylinder 105 and the communication hole 104*a* start communication therebetween. This moment is also the moment at which communication between the first discharge side space 115*b* of the first cylinder 105 and the communication hole 104*a* is completed. The volumetric capacity of the first discharge side space 115*b* is close to zero. In the second cylinder 106 side, the communication hole 104*a* is fully closed by the second piston 110. The volumetric capacity of the second discharge side space 116*b* is also close to zero. A section AB of an opening edge ABCD of the communication hole 104*a* is in agreement with the outer contour of the second piston 110.

Figure 3B:
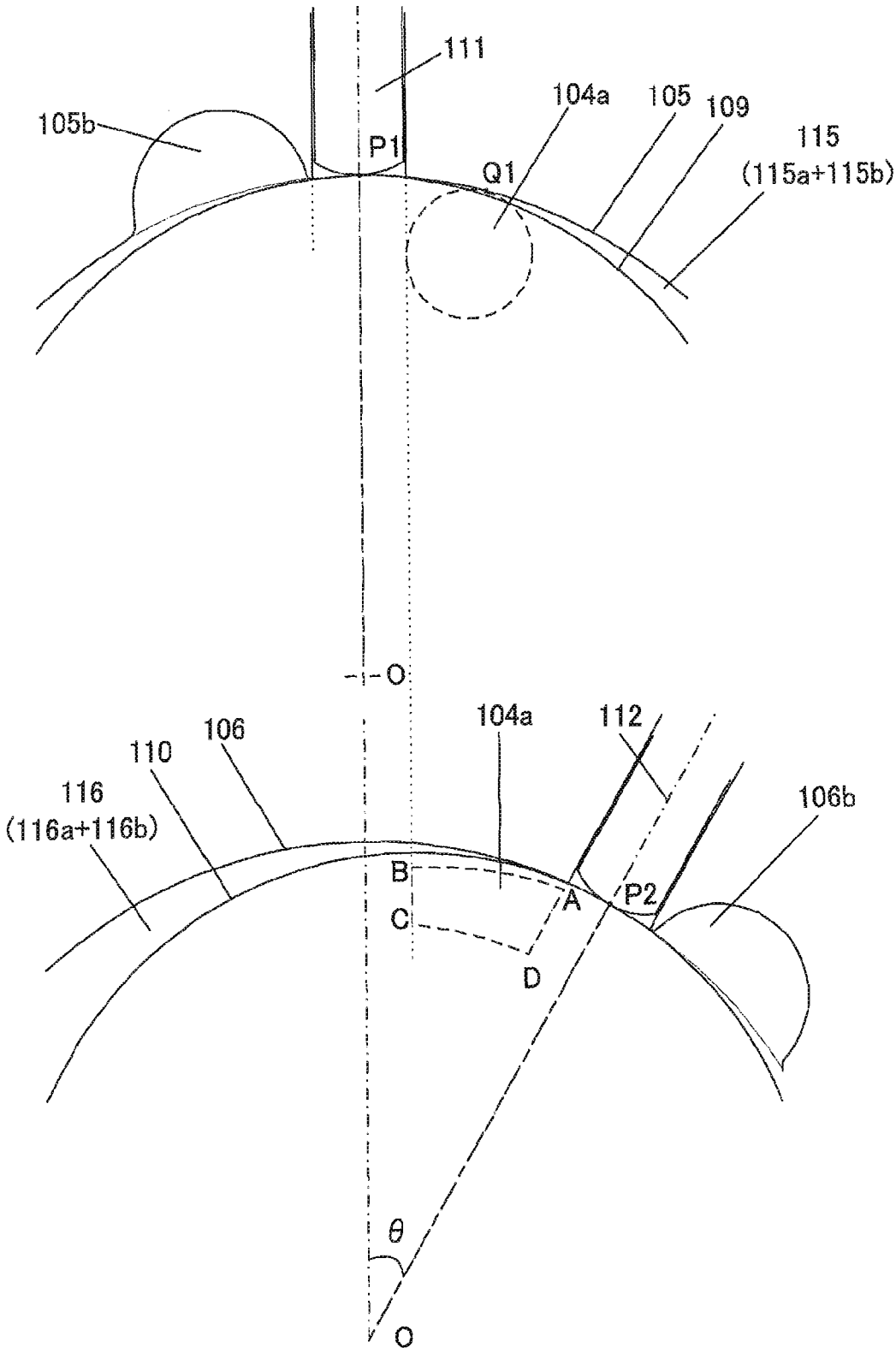
FIG. 3B is an operation explanatory view that follows FIG. 3A.

FIG. 3B illustrates the moment at which both the first piston 109 and a second piston 110 are at the top dead center, i.e., the moment at which the first vane 111 and the second vane 112 are compressed most. The spaces 115 between the first piston 109 and the first cylinder 105 are connected to form one space at the moment at which the first piston 109 is at the top dead center. Likewise, the spaces 116 between the second piston 110 and the second cylinder 106 are connected to form one space at the moment at which the second piston 110 is at the top dead center. The communication hole 104*a* has already been in communication with the space 115 (115*a*+115*b*) of the first cylinder 105, but it has not yet been in communication with the space 116 (116*a*+116*b*) of the second cylinder 106.

Figure 3C:
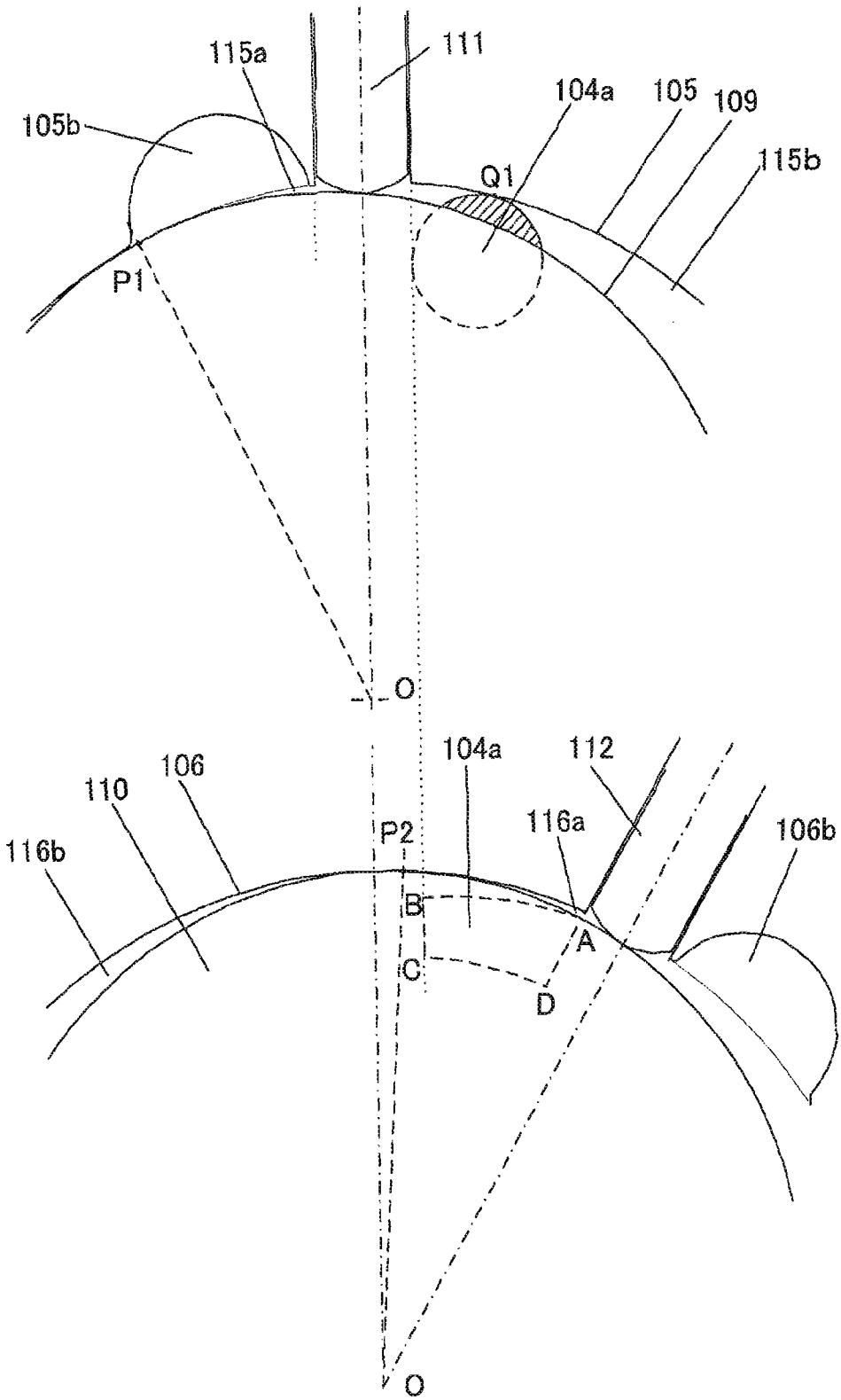
FIG. 3C is an operation explanatory view that follows FIG. 3B.

FIG. 3C illustrates the moment at which the communication hole 104*a* and the second suction side space 116*a* of the second cylinder 106 start communication therebetween.

Figure 3D:
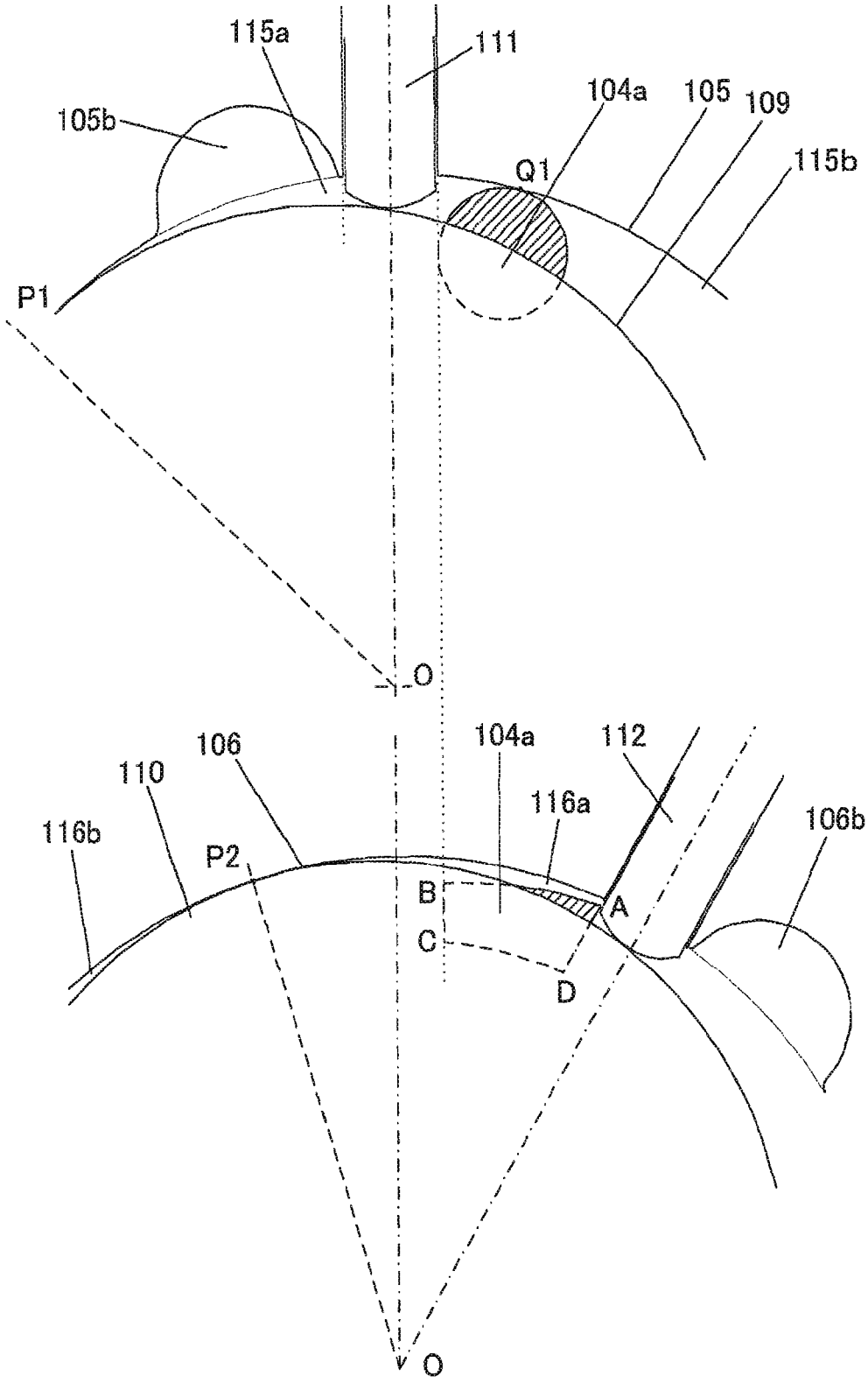
FIG. 3D is an operation explanatory view that follows FIG. 3C.

FIG. 3D illustrates the moment at which the shaft 103 has rotated 20° from FIG. 3C. The expansion chamber is formed by the first discharge side space 115*b* of the first cylinder 105, the second suction side space 116*a* of the second cylinder 106, and the communication hole 104*a*.

In order to prevent the blow-through phenomenon, the communication hole 104*a*, the second discharge side space 116*b* of the second cylinder 106, and the discharge port 106*b* should be inhibited from being in communication with each other during a period in which the suction port 105*b*, the first suction side space 115*a* of the first cylinder 105, and the communication hole 104*a* are in communication with each other. The opening shape and location of the communication hole 104*a* as well as the phases of the first piston 109 and the second piston 110 may be set so as to meet the just-mentioned condition.

The period in which the suction port 105*b* and the communication hole 104*a* are in communication with each other is a period corresponding to FIGS. 3A through 3C. Specifically, it is a period from the moment at which a contact point Q1 between the opening edge of the communication hole 104*a* and the inner circumferential surface of the first cylinder 105 matches a contact point P1 between the first piston 109 and the first cylinder 105 until the moment at which the contact point P1 between the first piston 109 and the first cylinder 105 goes out of the angular range in which the suction port 105*b* is formed, in other words, until the moment at which the entire suction port 105*b* is exposed in the first suction side space 115*a*. The angular ranges in which the suction port 105*b* and the discharge port 106*b* are formed correspond to the inner diameters of the suction pipe 117 and the discharge pipe 118. On the other hand, the opening of the communication hole 104*a* at the second cylinder 106 side is closed by the second piston 110 during the period corresponding to FIGS. 3A to 3C, and the second discharge side space 116*b* of the second cylinder 106 and the communication hole 104*a* are not in communication with each other. Therefore, the phenomenon in which the refrigerant blows through from the suction port 105*b* to the discharge port 106*b* directly cannot occur. As a result, the refrigerant that does not contribute to power recovery is eliminated, and the efficiency of the two-stage rotary expander is improved.

As illustrated in the upper view of FIG. 3A, the opening shape of the communication hole 104*a* at the first cylinder 105 side is a circular shape. However, the opening shape is not limited to a circular shape, but various other shapes also may be employed, such as an elliptical shape and a sector shape, which will be described later. In addition, the location of the communication hole 104*a* may be determined so that the opening edge of the communication hole 104*a* at the first cylinder 105 side is in contact with both the inner circumferential surface of the first cylinder 105 and the range of motion of the first vane 111. This is advantageous for reducing the space that does not work as an expansion chamber and hinders the generation of the brake torque that is in an opposite direction to the direction of rotation of the shaft 103.

On the other hand, in the second cylinder 106 side, the location of the communication hole 104*a* is set so that, as illustrated in the lower view of FIG. 3A, the section AB (first section) of the opening edge ABCD overlaps with a virtual circle that has the same diameter as the second piston 110 and is inscribed to the second cylinder 106. Specifically, the section AB of the opening edge ABCD of the communication hole 104*a* forms a circular arc shape in accordance with the outer contour of the second piston 110 that is at the moment at which communication between the communication hole 104*a* and the first discharge side space 115*b* is blocked (the moment of FIG. 3A). The phases of the first piston 109 and the second piston 110 are set so that the moment at which communication between the first discharge side space 115*b* and the communication hole 104*a* is blocked matches the moment at which communication between the second suction side space 116*a* and the communication hole 104*a* is blocked. In this way, the refrigerant can be prevented from directly blowing through from the suction port 105*b* to the discharge port 106*b* at any rotation angle of the shaft 103, and moreover, the pressure loss at the time when the refrigerant passes through the communication hole 104*a* can be made as small as possible.

However, the section AB of the opening edge ABCD of the communication hole 104*a* may not overlap with the outer contour of the second piston 110 at the moment of FIG. 3A. Specifically, the entirety of the opening edge ABCD of the communication hole 104*a* at the second cylinder 106 side may be located closer to the center of the shaft 103 than the outer contour of the second piston 110 at the moment of FIG. 3A at which the communication hole 104*a* and the first suction side space 115*a* start communication therebetween. In this case as well, the same effect of preventing the blow-through can be obtained.

The entirety of the opening edge ABCD of the communication hole 104*a* at the second cylinder 106 side is spaced apart from the inner circumferential surface of the second cylinder 106. This makes it possible to keep the fully closed state of the communication hole 104*a* in the second cylinder 106 side until the period passes in which the suction port 105*b*, the first suction side space 105*a* of the first cylinder 105, and the communication hole 104*a* are in communication with each other.

Figure 4A:
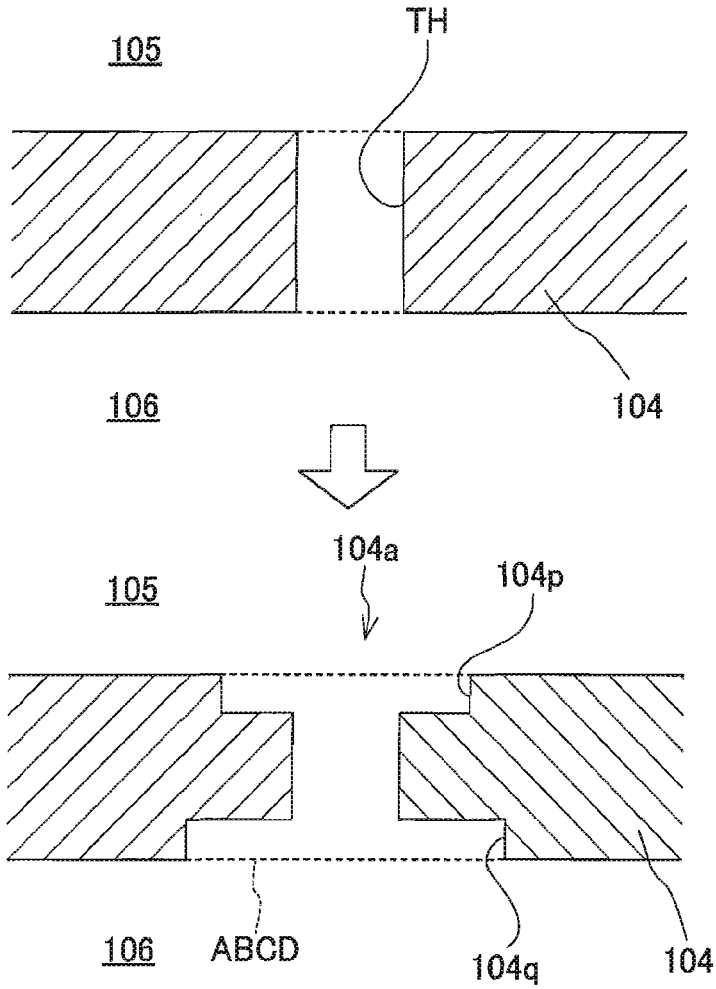
FIG. 4A is a vertical cross-sectional view of a communication hole.
Figure 4B:
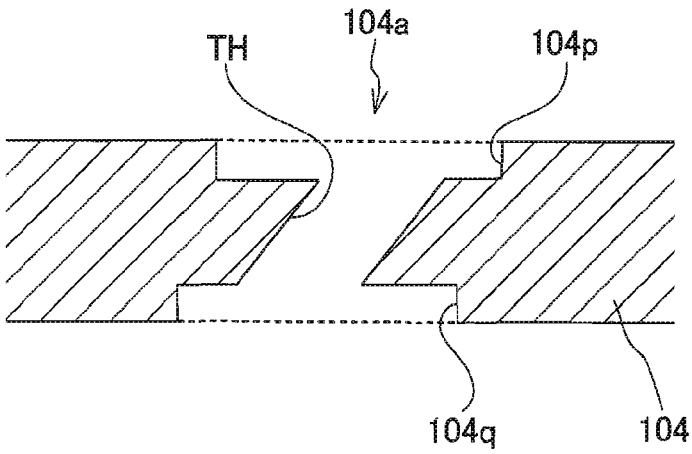
FIG. 4B is a vertical cross-sectional view of another example of the communication hole.

In the present embodiment, the opening shapes of the communication hole 104*a* are made different between the first cylinder 105 side and the second cylinder 106 side. This difference in opening shape may be produced in the following manner. First, a through hole TH with a circular shape in horizontal cross section is formed so as to penetrate through the intermediate plate 104, as illustrated in FIG. 4A. Next, counter borings 104*p* and 104*q* are formed by boring the surrounding portion of the through hole TH, to form the communication hole 104*a* including the counter borings 104*p* and 104*q*. In this way, the opening shapes of the communication hole 104*a* can be adjusted freely in the front and back faces of the intermediate plate 104. The opening edge ABCD of the communication hole 104*a* at the second cylinder 106 side is formed by the counter boring 104*q*. Processing of the counter borings 104*p* and 104*q* is relatively easy, so the problem of cost increase does not arise. Such a counter boring may be provided only at the second cylinder 106 side or only at the first cylinder 105 side. Moreover, as shown in FIG. 4B, the through hole TH formed in the intermediate plate 104 may be a slanting hole whose horizontal cross-sectional shape is elliptical. It is preferable that the areas of openings determined by the counter borings 104*p* and 104*q* be the same in the first cylinder 105 side and the second cylinder 106 side, to prevent an increase in pressure loss.

In addition, the opening shape and location of the communication hole 104*a* may be set so that a section AD (second section) of the opening edge ABCD at the second cylinder 106 side is along the range of motion of the second vane 112. Specifically, as illustrated in FIG. 3A, the section AD of the opening edge ABCD of the communication hole 104*a* overlaps with the extension line of the second vane groove 106*a*. Providing the communication hole 104*a* as close as possible to the second vane 112 is effective for reducing the space that does not work as an expansion chamber. This serves to reduce the brake torque resulting from rotation of the shaft 103 in the condition in which there is no refrigerant in the second suction side space 116*a*.

In addition, the opening shape and location of the communication hole 104*a* may be set so that the entirety of the opening edge ABCD stays within the angular range between the first vane groove 105*a* and the second vane groove 106*a*. An extension line of the first vane groove 105*a* is projected onto the intermediate plate 104, and a section BC (third section) of the opening edge ABCD may be set on the projected extension line. It is recommended that a point C and a point D, which form a section CD (fourth section) of the opening edge ABCD be set so that the areas of the openings of the communication hole 104*a* are eventually equal to each other in the first cylinder 105 side and the second cylinder 106 side. Although the section CD is illustrated as a curve in the present embodiment, this is merely illustrative and the section CD may be a straight line.

In addition, as will be understood from FIG. 3C, it is preferable that, in the first cylinder 105 side, the contact point P1 between the outer circumferential surface of the first piston 109 and the inner circumferential surface of the first cylinder 105 should be located at an edge of the suction port 105*b* (i.e., an edge thereof that is on the forward side with respect to the direction of rotation of the shaft 103) at the moment at which the second suction side space 116*a* of the second cylinder 106 and the communication hole 104*a* start communication therebetween. That is, the phases of the first piston 109 and the second piston 110 are set so that the moment at which communication between the suction port 105*b* and the first discharge side space 115*b* is cut off matches the moment at which the first discharge side space 115*b*, the communication hole 104*a*, and the second suction side space 116*a* start communication therebetween.

If the communication between the suction port 105*b* and the first discharge side space 115*b* is cut off prior to the moment at which the first discharge side space 115*b* and the second suction side space 116*a* start communication therebetween, the refrigerant filling the first discharge side space 115*b* may be compressed. If the suction port 105*b* and the first discharge side space 115*b* are kept in communication although the first discharge side space 115*b* and the second suction side space 116*a* start communication therebetween, the suction process becomes longer and correspondingly the expansion process becomes shorter, so the expansion ratio becomes small relative to the size of the cylinder.

It should be noted that the moment at which communication between the suction port 105*b* and the first discharge side space 115*b* is cut off (i.e., suction completion time) and the moment at which the first discharge side space 115*b* and the second suction side space 116*a* start communication therebetween (i.e., expansion start time) may be slightly different, for example, in the following manners: (1) the first discharge side space 115*b* and the second suction side space 116*a* start communication therebetween at the time when the shaft 103 has rotated by a very small angle (for example, 1 degree to 3 degrees, more preferably 1 degree to 2 degrees) from the moment at which communication between the suction port 105*b* and the first discharge side space 115*b* was cut off, or (2) communication between the suction port 105*b* and the first discharge side space 115*b* is cut off at the time when the shaft 103 has rotated by a very small angle (for example, 1 degree to 3 degrees, more preferably 1 degree to 2 degrees) from the moment at which the first discharge side space 115*b* and the second suction side space 116*a* started communication therebetween. The reason is because there will be little adverse effect on the efficient recovery of the energy of expansion if the time difference between the two incidents is only within a very short period in which the blow-through phenomenon of the refrigerant can not occur.

Second Embodiment

As illustrated in FIGS. 5A to 5D, in a second embodiment, the first vane 111 and the second vane 112 are disposed at angular positions that are in agreement with each other around the rotation axis O of the shaft 103. A communication hole 104*b* is formed in the intermediate plate 104 so as to cross a plane, that contains longitudinal center lines of the first vane 111 and the second vane 112 and the rotation axis O of the shaft 103, from one side to the other side and to extend in a slanted direction with respect to the rotation axis O of the shaft 103. Such an arrangement in which the two vanes 111 and 112 overlap axially vertically is advantageous for reducing the overall size of the expansion mechanism 120 (see FIG. 1). An expansion mechanism having substantially the same configuration as that of the first embodiment can be employed by using the communication hole 104*b* that penetrates the intermediate plate 104 diagonally in a plate thickness direction (a communication hole such as illustrated in FIG. 4B).

In the previous first embodiment, the eccentric direction of the first piston 109 (=which agrees with the eccentric direction of the first eccentric portion 103*a*) and the eccentric direction of the second piston 110 (=which agrees with the eccentric direction of the second eccentric portion 103*b*) are different from each other, and as a result, the top dead center times of the two pistons 109 and 110 agree with each other. In contrast, in the present embodiment, the disposed angle of the first vane 111 and the disposed angle of the second vane 112 agree with each other and the eccentric direction (i.e., phase) of the first piston 109 and the eccentric direction of the second piston 110 agree with each other, whereby the top dead center times of the two pistons 109 and 110 agree with each other.

Figure 5A:
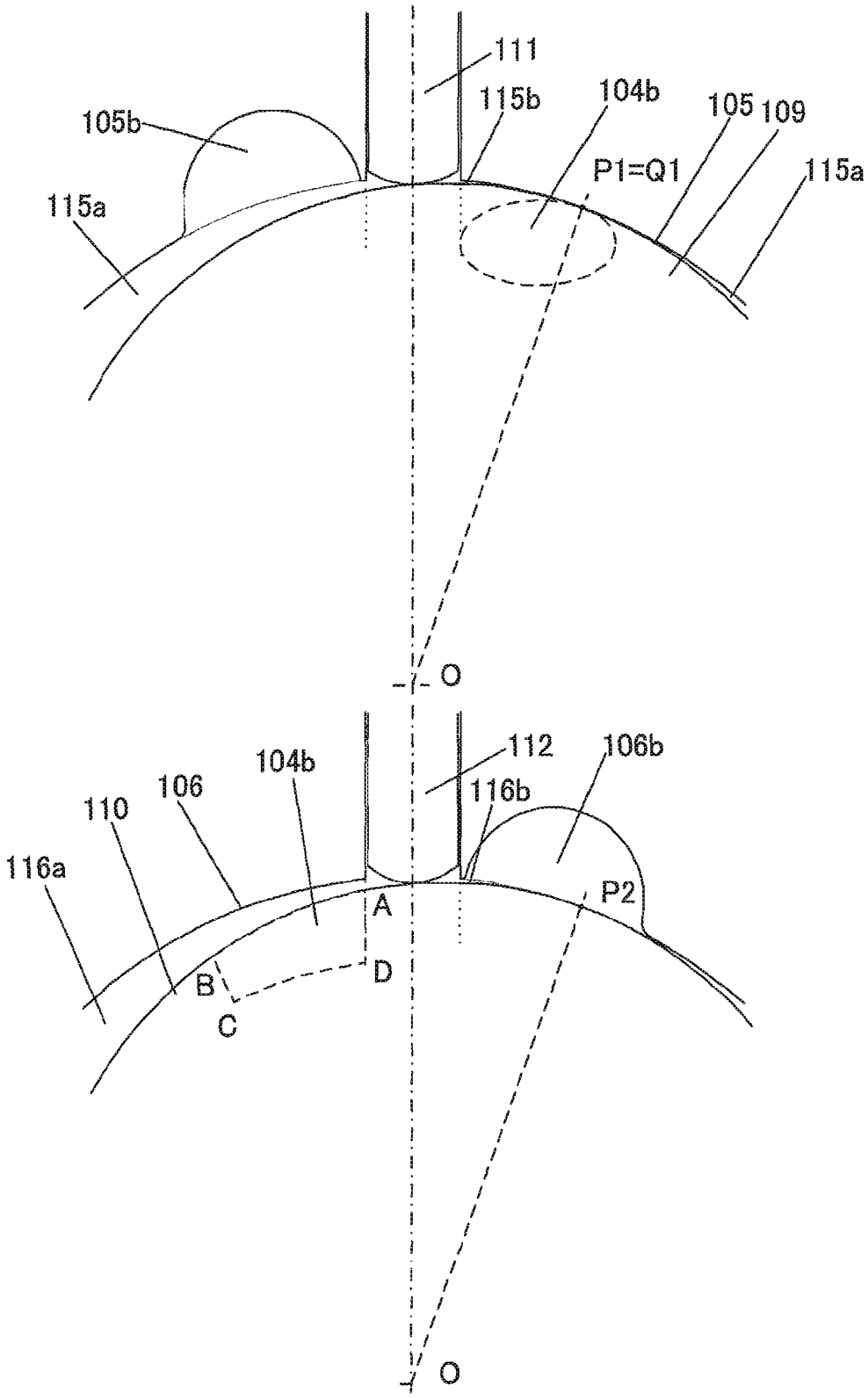
FIG. 5A is an operation explanatory view illustrating how a communication hole and a working chamber are allowed to communicate with each other in a second embodiment.

FIG. 5A illustrates the moment at which the first suction side space 115*a* of the first cylinder 105 and the communication hole 104*b* start communication therebetween. This moment is also the moment at which the communication hole 104*b* is closed by the second piston 110. In other words, in the second cylinder 106 side, the communication hole 104*b* is fully closed by the second piston 110. A section AB of an opening edge ABCD of the communication hole 104*b* is in agreement with the outer contour of the second piston 110. The communication hole 104*b* in which the opening shape appearing at the first cylinder 105 side is elliptical can be formed by making a hole diagonally into the intermediate plate 104. It should be noted, however, that the opening shape may be adjusted freely by forming a counter boring such as illustrated in FIG. 4A.

Figure 5B:
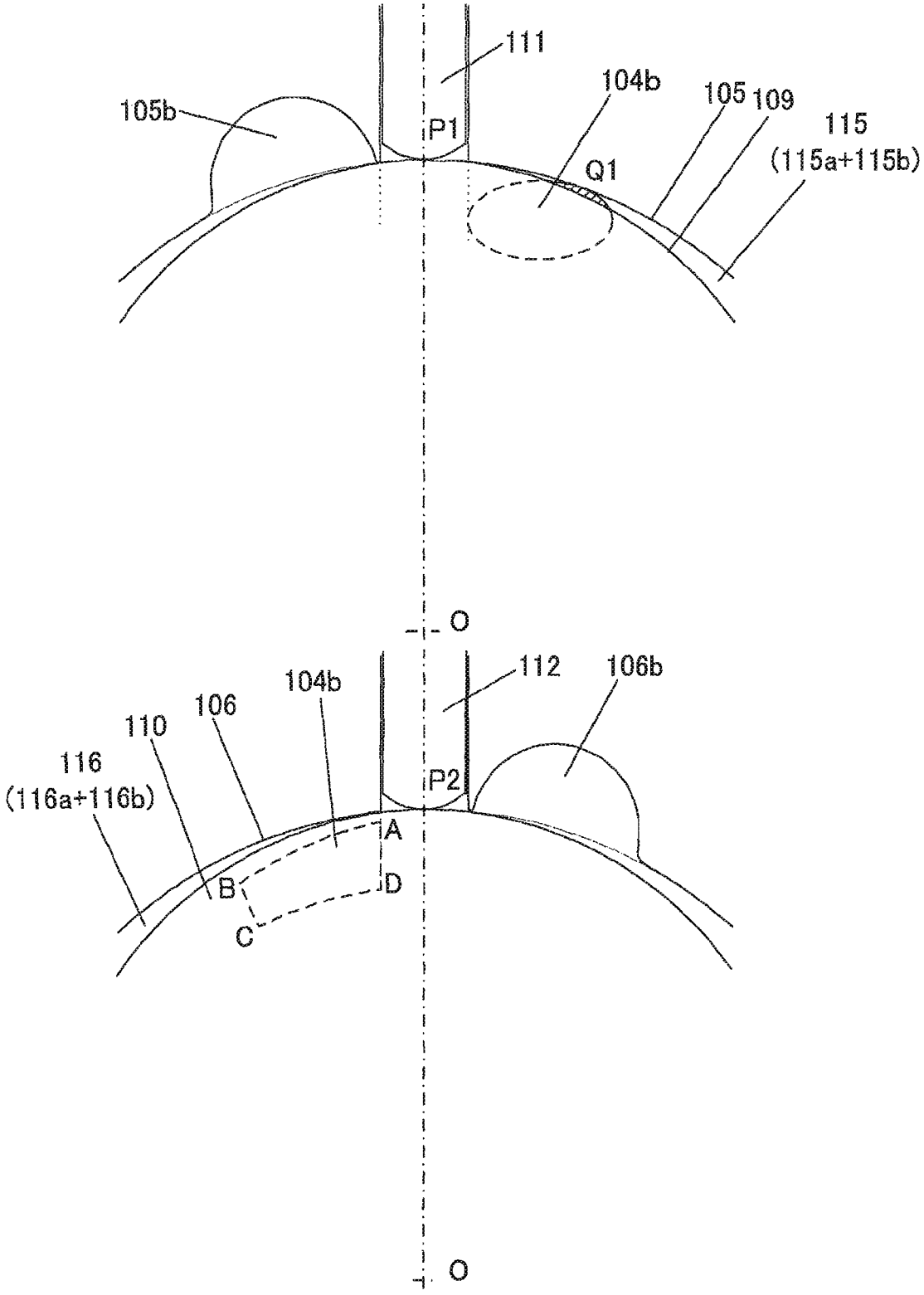
FIG. 5B is an operation explanatory view that follows FIG. 5A.

FIG. 5B illustrates the moment at which both the first piston 109 and a second piston 110 are at the top dead center, i.e., the moment at which the first vane 111 and the second vane 112 are compressed most. The communication hole 104*b* already has been in communication with the space 115 (115*a*+115*b*) of the first cylinder 105, but it has not yet been in communication with the space 116 (116*a*+116*b*) of the second cylinder 106.

Figure 5C:
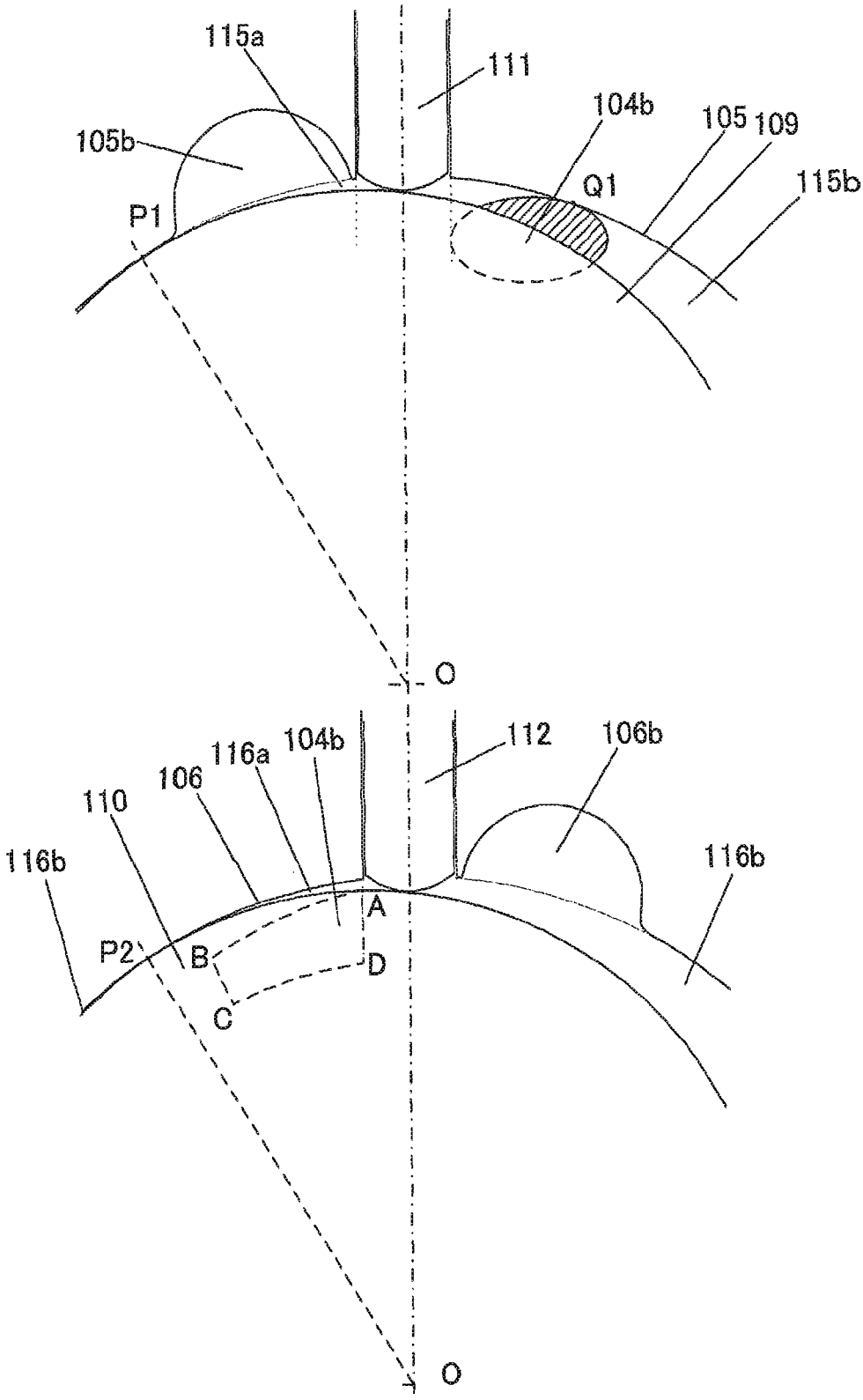
FIG. 5C is an operation explanatory view that follows FIG. 5B.

FIG. 5C illustrates the moment at which the communication hole 104*b* and the second suction side space 116*a* of the second cylinder 106 start communication therebetween. It is only at this moment that the supply of the refrigerant is started from the communication hole 104*b* to the second suction side space 116*a* of the second cylinder 106.

Figure 5D:
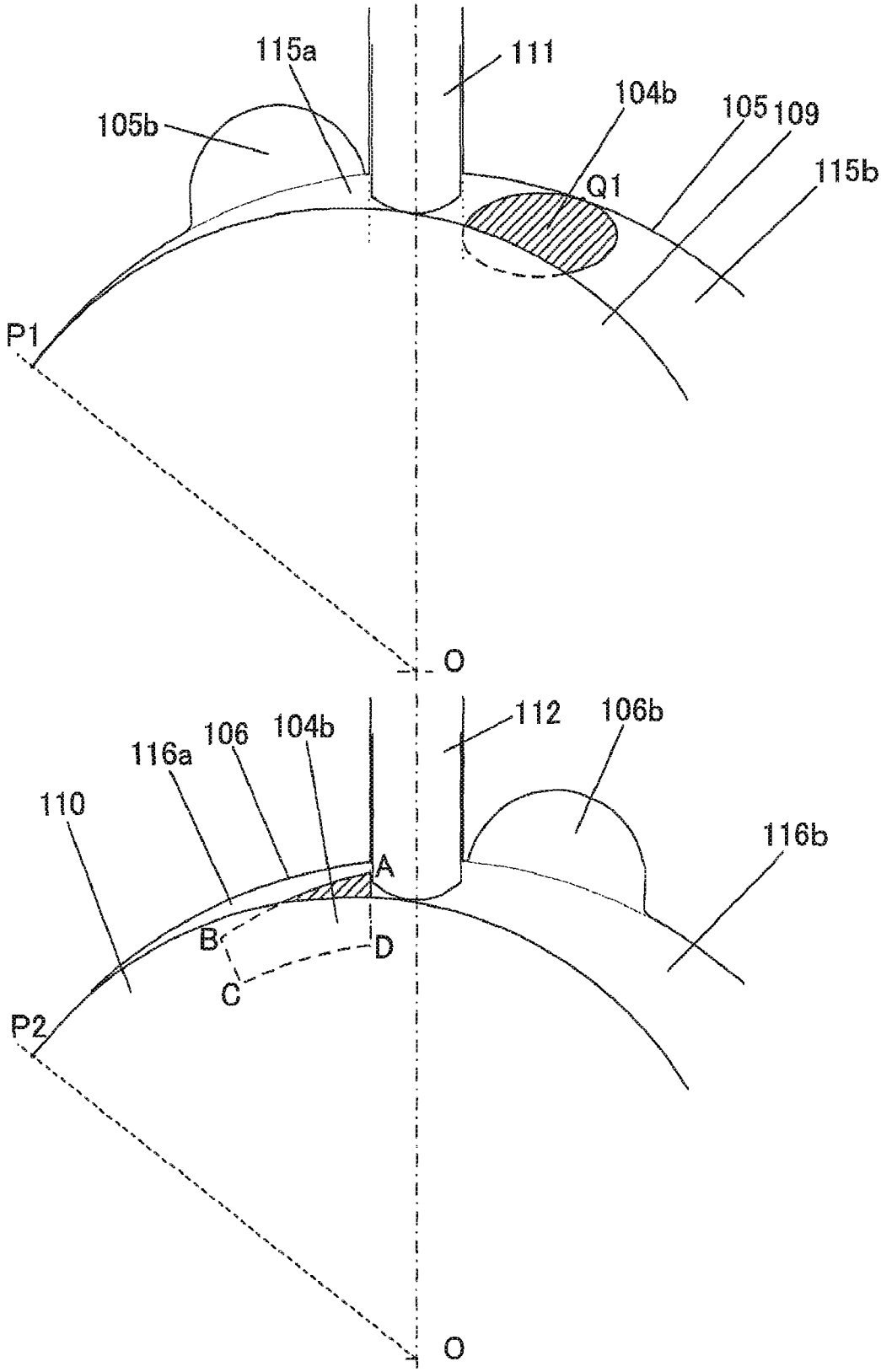
FIG. 5D is an operation explanatory view that follows FIG. 5C.

FIG. 5D illustrates the moment at which the shaft 103 has rotated 20° from FIG. 5C. The expansion chamber is formed by the first discharge side space 115*b* of the first cylinder 105, the second suction side space 116*a* of the second cylinder 106, and the communication hole 104*c*.

As will be appreciated from FIGS. 5A to 5D, the period in which the refrigerant can blow through from the suction port 105*b* to the discharge port 106*b* does not exist in the present embodiment as well.

Third Embodiment

In the first embodiment, the opening shape and location of the communication hole 104*a* are set so that the opening edge ABCD is spaced apart from the inner circumferential surface of the second cylinder 106. In contrast, in the present embodiment, the opening shape and location of a communication hole 104*c* is set so that the opening edge ABCD is in contact with the inner circumferential surface of the second cylinder 106, as illustrated in FIGS. 6A to 6D. Specifically, a point A, which is one point on the opening edge ABCD, is set on the inner circumferential surface of the second cylinder 106 and on an edge of the second vane groove 106*b* (see FIG. 2B). The first section AB of the opening edge ABCD is in a circular arc shape as in the first embodiment. The remaining sections AD, BC, and CD also may be defined in the same way as in the first embodiment.

In the present embodiment, the first vane 111 and the second vane 112 are disposed in a substantially V-shape when viewed in plan. This point is common to the first embodiment. However, the time at which the first piston 109 reaches the top dead center and the time at which the second piston 110 reaches the top dead center are not in agreement.

A difference between the communication hole 104*a* of the first embodiment (see FIG. 3A) and the communication hole 104*c* of the present embodiment is whether the opening edge ABCD is in contact with the inner circumferential surface of the second cylinder 106 or spaced apart therefrom. From a holistic point of view, there is a difference in structure, the difference being that the top dead center time of the first piston 109 and the top dead center time of the second piston 110 are different.

Figure 6A:
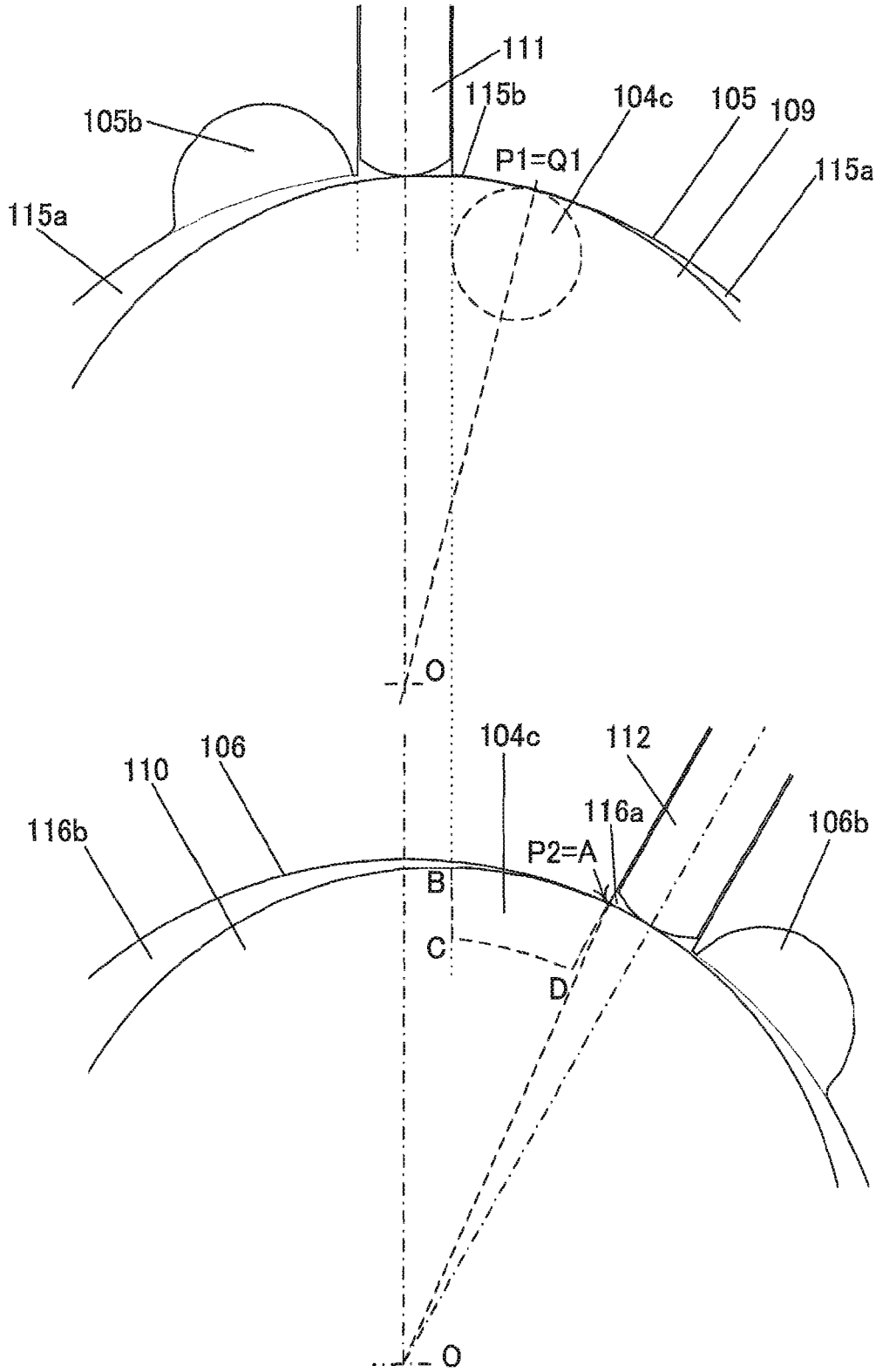
FIG. 6A is an operation explanatory view illustrating how a communication hole and a working chamber are allowed to communicate with each other in a third embodiment.
Figure 6B:
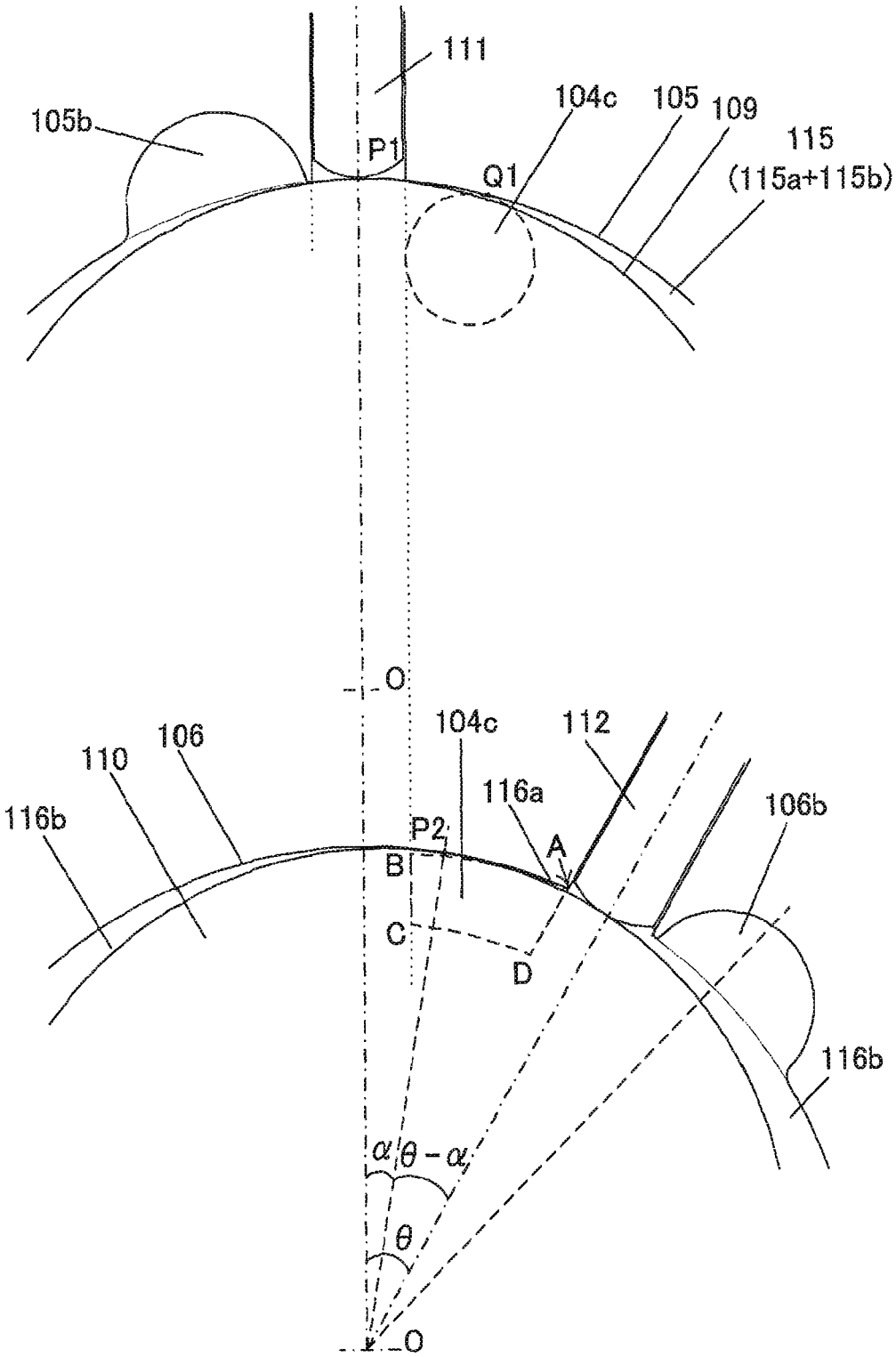
FIG. 6B is an operation explanatory view that follows FIG. 6A.

Specifically, as illustrated in FIG. 6B, the eccentric directions of the pistons 109 and 110 are determined so that the top dead center time of the second piston 110 arrives earlier than the top dead center time of the first piston 109. The angle $\theta$ formed by the first vane 111 and the second vane 112 is different from the angle $\alpha$ formed by the eccentric direction of the first eccentric portion 103*a* and the eccentric direction of the second eccentric portion 103*b*. The top dead center time of the second piston 106 is $(\theta-\alpha)$ degrees in advance of the top dead center time of the first piston 105. In other words, the phase of the second piston 106 is $(\theta-\alpha)$ degrees in advance of the phase of the first piston 105.

FIG. 6A illustrates the moment at which the first suction side space 115*a* of the first cylinder 105 and the communication hole 104*c* start communication therebetween. In the second cylinder 106 side, the communication hole 104*c* is fully closed by the second piston 110. The section AB of the opening edge ABCD of the communication hole 104*c* is in agreement with the outer contour of the second piston 110. The contact point P1 between the first cylinder 105 and the first piston 109 is at the contact point Q1 between the inner circumferential surface of the first cylinder 105 and the communication hole 104*c*, and the first piston 109 almost reaches the top dead center. On the other hand, the contact point P2 between the second cylinder 106 and the second piston 110 is at a point A on the opening edge ABCD of the communication hole 104*c*, and the second piston 110 has already been past the top dead center. The moment of FIG. 6A is also the moment at which the second suction side space 116*a* of the second cylinder 106 and the communication hole 104*c* start communication therebetween. The communication hole 104*c* starts to allow communication with both the first suction side space 115*a* of the first cylinder 105 and the second suction side space 116*a* of the second cylinder 106 at the same time.

FIG. 6B illustrates the moment at which the first piston 109 reaches the top dead center. The communication hole 104*c* is in communication with both the space 115 of the first cylinder 105 and the second suction side space 116*a* of the second cylinder 106, but the contact point P2 between the second cylinder 106 and the second piston 110 blocks the passage to the discharge port 106*b*. Therefore, the blow-through phenomenon cannot occur. The period in which the shaft 103 rotates under the condition in which there is no refrigerant in the second suction side space 116*a* of the second cylinder 106, i.e. the period in which brake torque is generated, is almost non-existent.

Figure 6C:
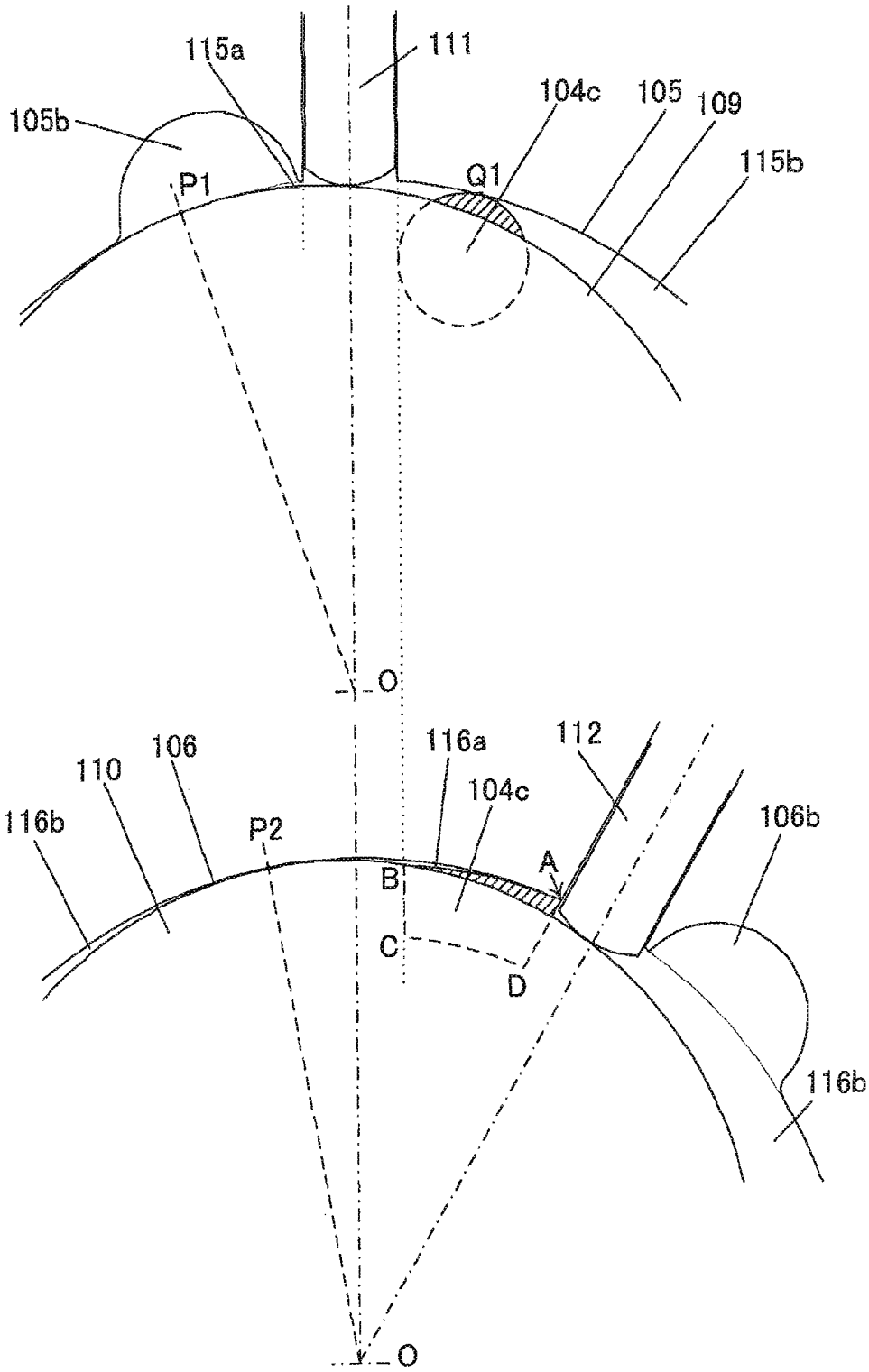
FIG. 6C is an operation explanatory view that follows FIG. 6B.
Figure 6D:
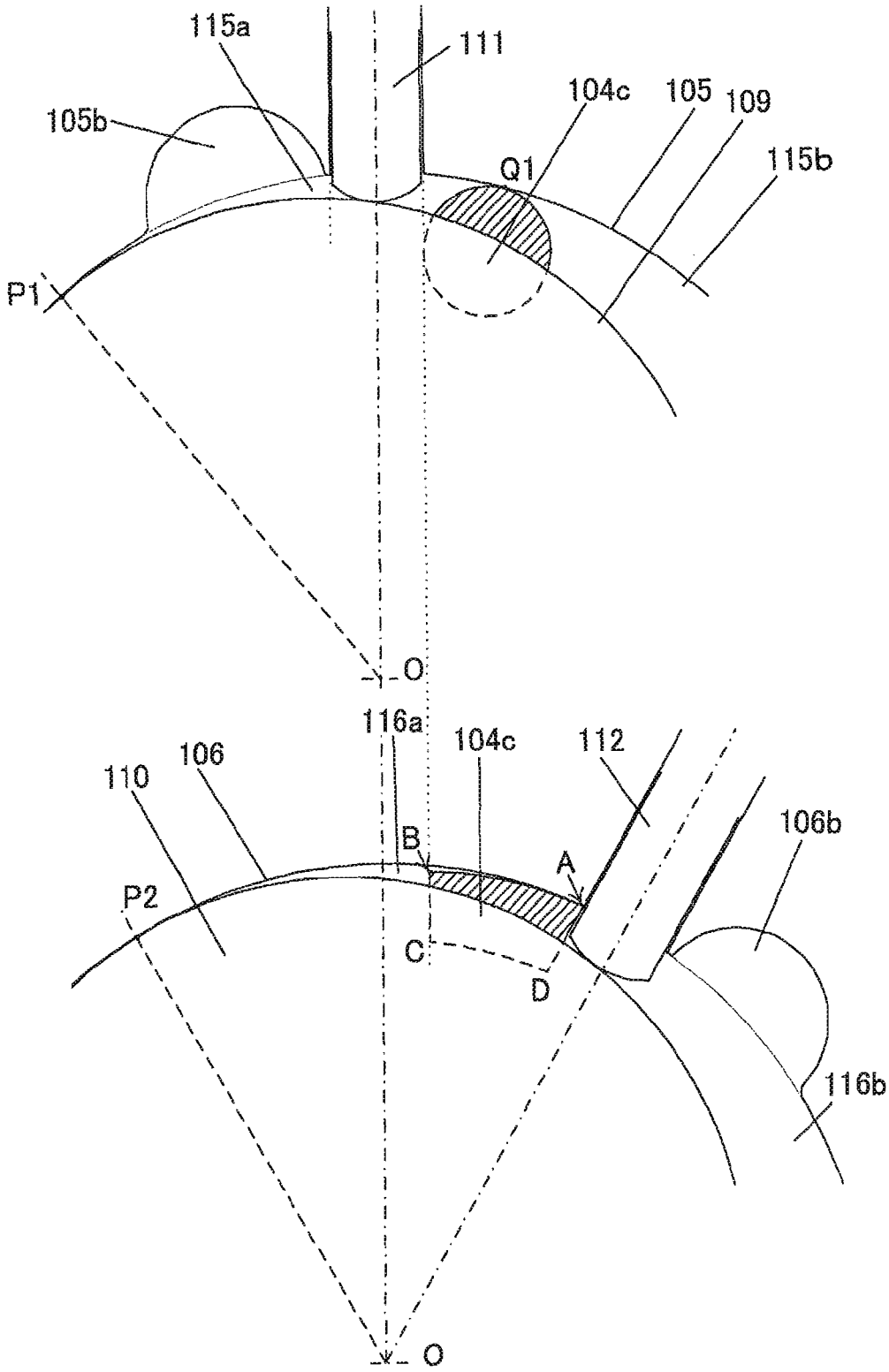
FIG. 6D is an operation explanatory view that follows FIG. 6C.

FIG. 6C illustrates the moment at which the shaft 103 has rotated 20° from FIG. 6B, and FIG. 6D illustrates the moment at which the shaft 103 has rotated 20° from FIG. 6C. The communication hole 104*c* is in communication with both the first discharge side space 115*b* of the first cylinder 105 and the second suction side space 116*a* of the second cylinder 106, and the communication area is increasing. Expansion of the refrigerant starts from the time point at which the contact point P1 between the first cylinder 105 and the first piston 109 reaches an edge of the suction port 105*b* in the direction of rotation of the shaft 103.

As will be appreciated from FIGS. 6A to 6D, the period in which the refrigerant can blow through from the suction port 105*b* to the discharge port 106*b* does not exist in the present embodiment as well.

Thus, by adjusting the eccentric directions of the pistons 109 and 110 in addition to the setting of the opening shape and location of the communication hole 104*c*, it is made possible to provide a two-stage rotary expander in which the blow-through phenomenon of the refrigerant cannot occur and the period in which brake torque is generated is very short.

Fourth Embodiment

A fourth embodiment, illustrated in FIGS. 7A to 7D, can be conceived as an embodiment that combines (i) the second embodiment, in which the first vane 111 and the second vane 112 are disposed at an angle at which they are in agreement with each other, and (ii) the third embodiment, in which the opening shape and location of the communication hole 104*c* are set so that the opening edge ABCD is in contact with the inner circumferential surface of the second cylinder 106. The top dead center time of the first piston 109 and that of the second piston 110 are different from each other, as in the third embodiment.

Figure 7A:
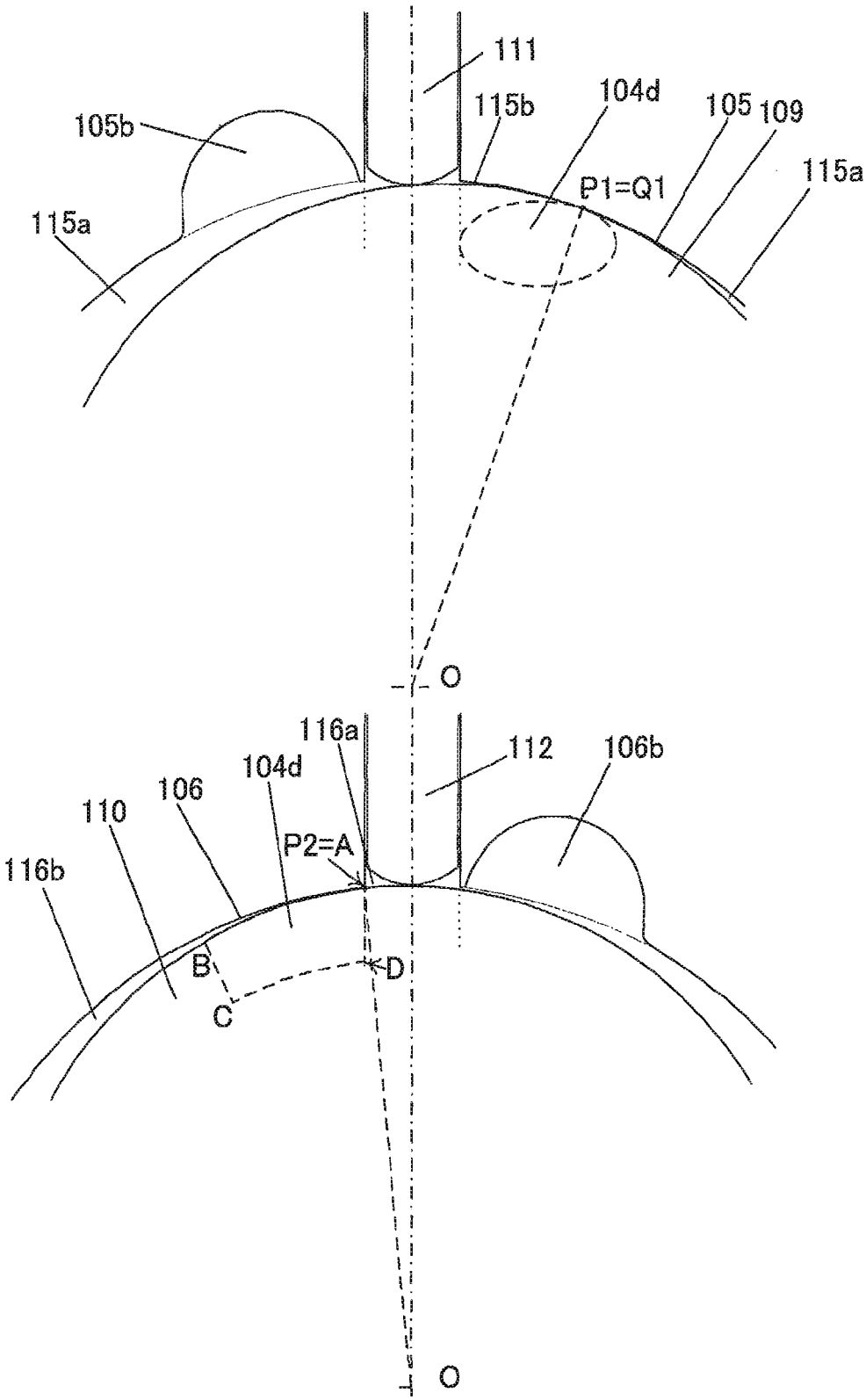
FIG. 7A is an operation explanatory view illustrating how a communication hole and a working chamber are allowed to communicate with each other in a fourth embodiment.

FIG. 7A illustrates the moment at which the first suction side space 115*a* of the first cylinder 105 and a communication hole 104*d* start communication therebetween. In the second cylinder 106 side, the communication hole 104*d* is fully closed by the second piston 110. A section AB of an opening edge ABCD of the communication hole 104*d* is in agreement with the outer contour of the second piston 110. The contact point P1 between the first cylinder 105 and the first piston 109 is at the contact point Q1 between the inner circumferential surface of the first cylinder 105 and the communication hole 104*d*, and the first piston 109 almost reaches the top dead center. On the other hand, the contact point P2 between the second cylinder 106 and the second piston 110 is at a point A on the opening edge ABCD of the communication hole 104*d*, and the second piston 110 already has been past the top dead center. The moment of FIG. 7A is also the moment at which the second suction side space 116*a* of the second cylinder 106 and the communication hole 104*d* start communication therebetween. The communication hole 104*d* starts to allow communication with both the first suction side space 115*a* of the first cylinder 105 and the second suction side space 116*a* of the second cylinder 106 at the same time.

Figure 7B:
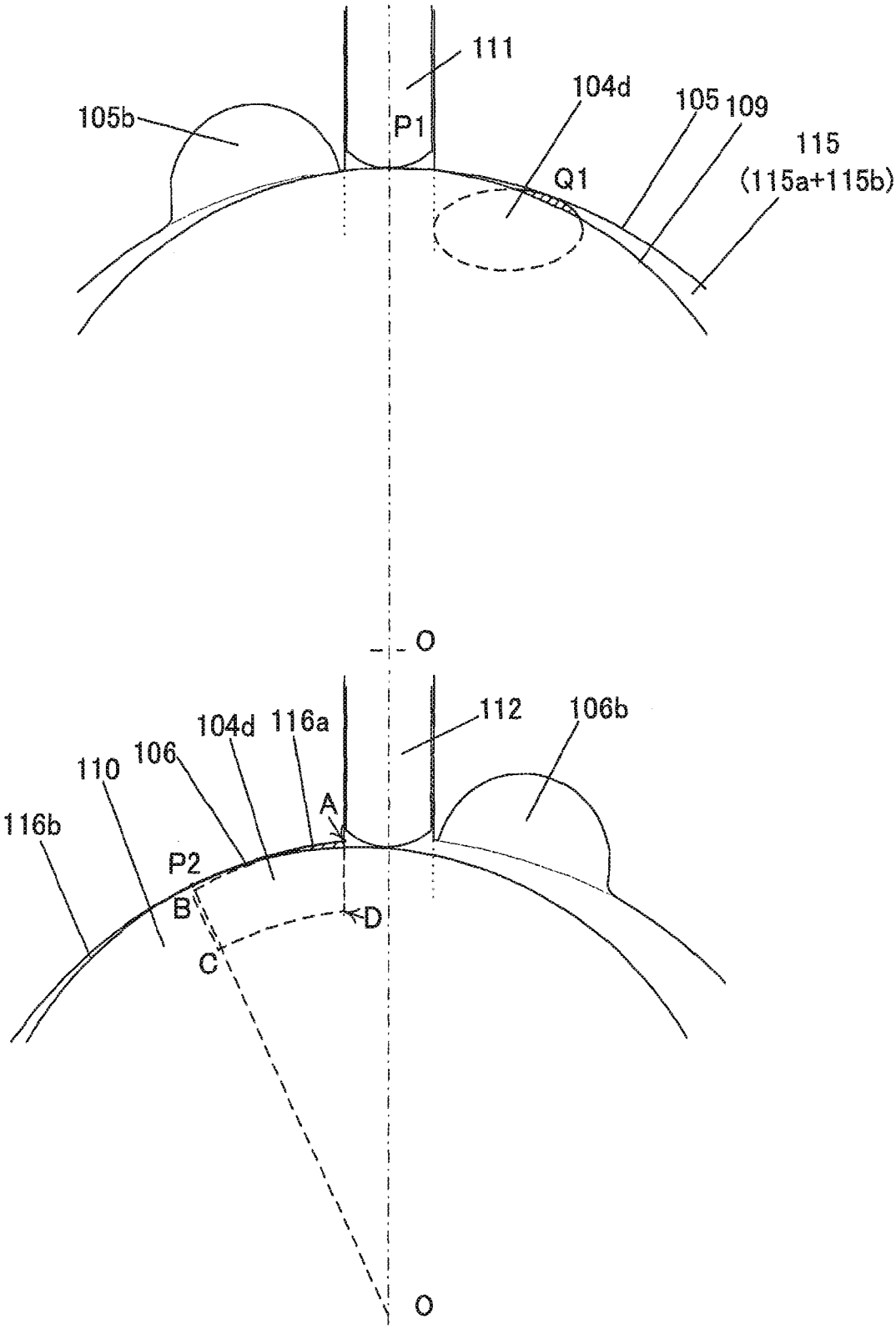
FIG. 7B is an operation explanatory view that follows FIG. 7A.

FIG. 7B illustrates the moment at which the first piston 109 reaches the top dead center. The communication hole 104*d* is in communication with both the space 115 of the first cylinder 105 and the second suction side space 116*a* of the second cylinder 106, but the contact point P2 between the second cylinder 106 and the second piston 110 blocks the passage to the discharge port 106*b*. Therefore, the blow-through phenomenon cannot occur.

Figure 7C:
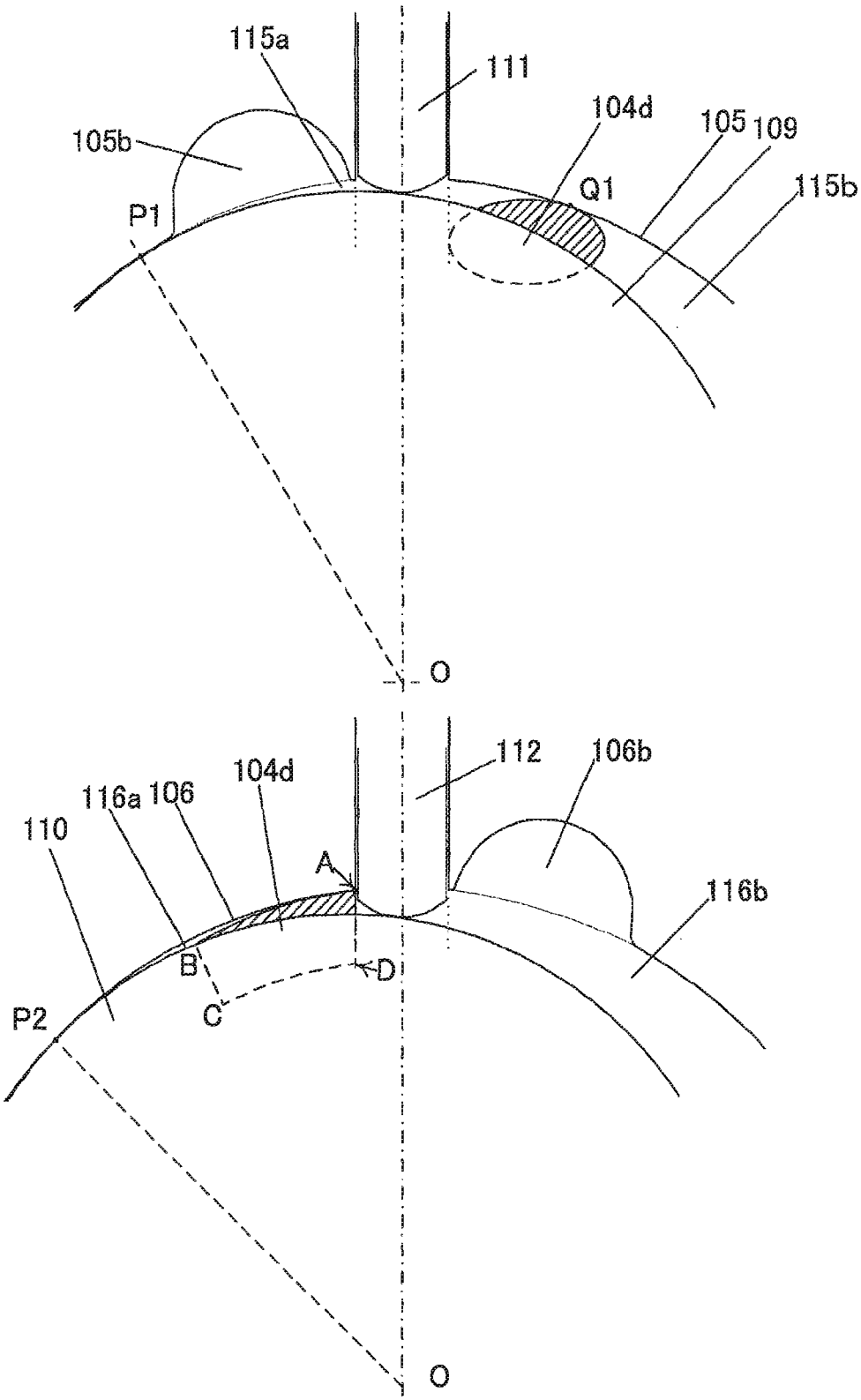
FIG. 7C is an operation explanatory view that follows FIG. 7B.
Figure 7D:
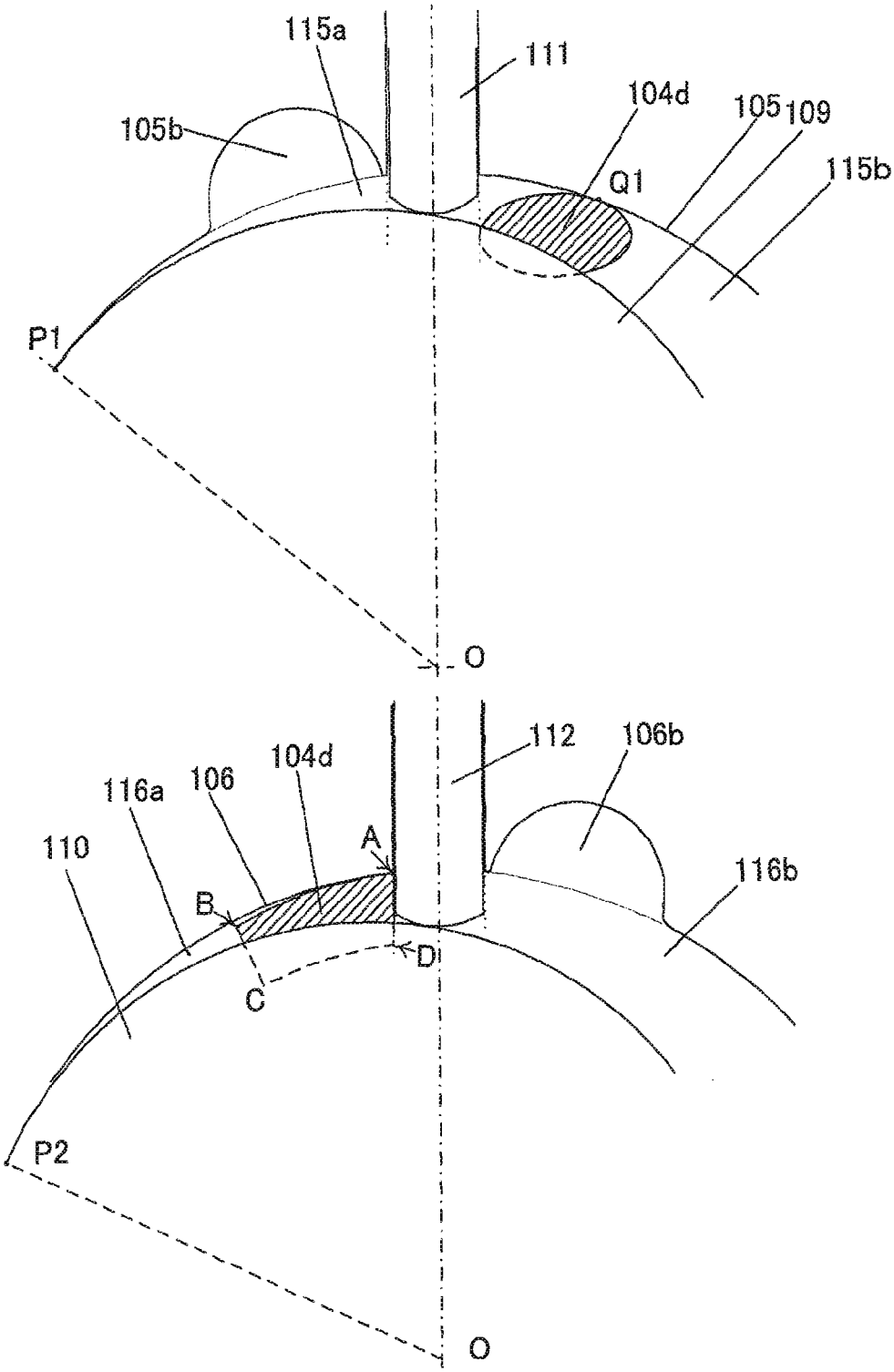
FIG. 7D is an operation explanatory view that follows FIG. 7C.
Figure 8A:
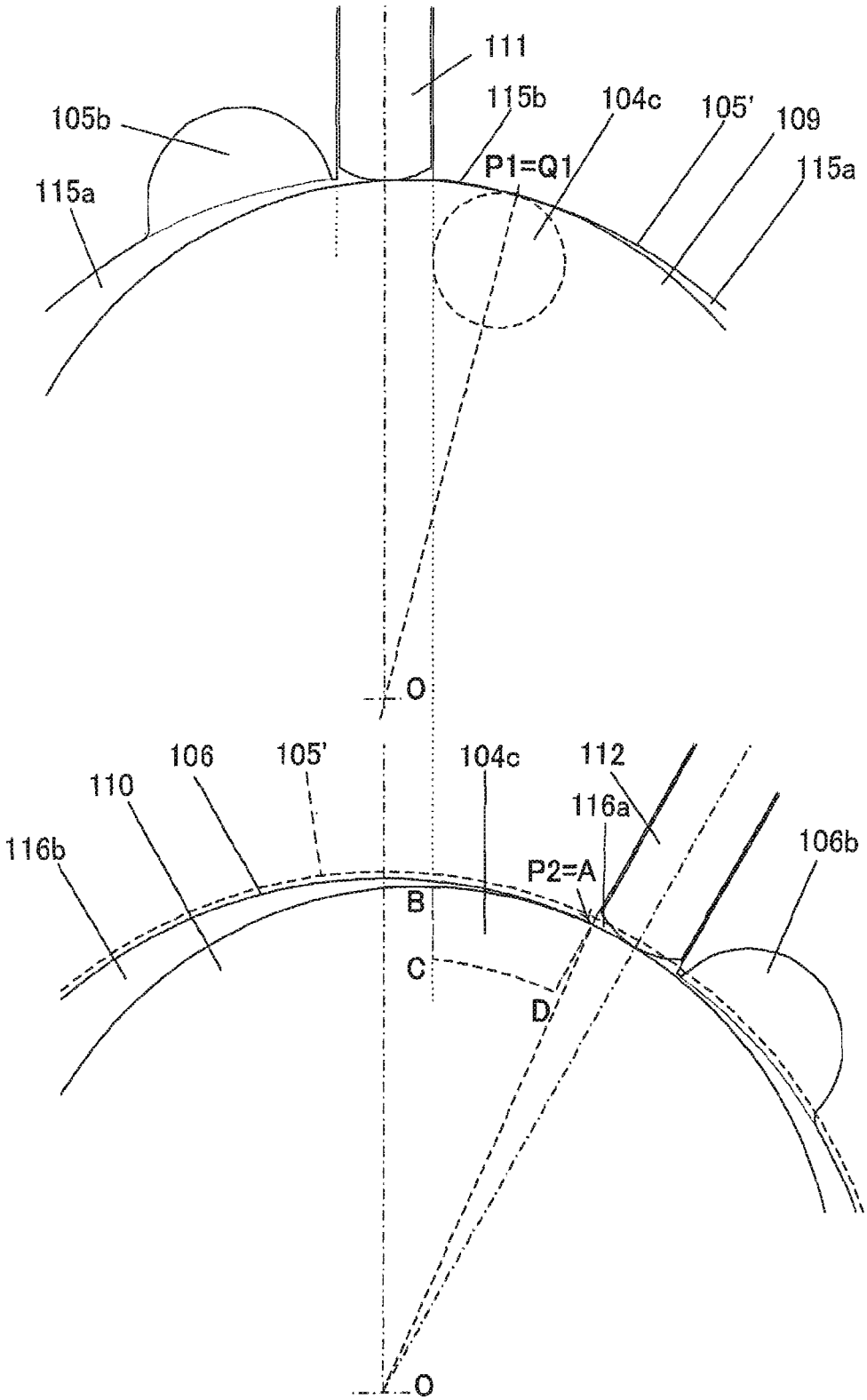
FIG. 8A is an operation explanatory view illustrating how a communication hole and a working chamber are allowed to communicate with each other in a fifth embodiment.
Figure 8B:
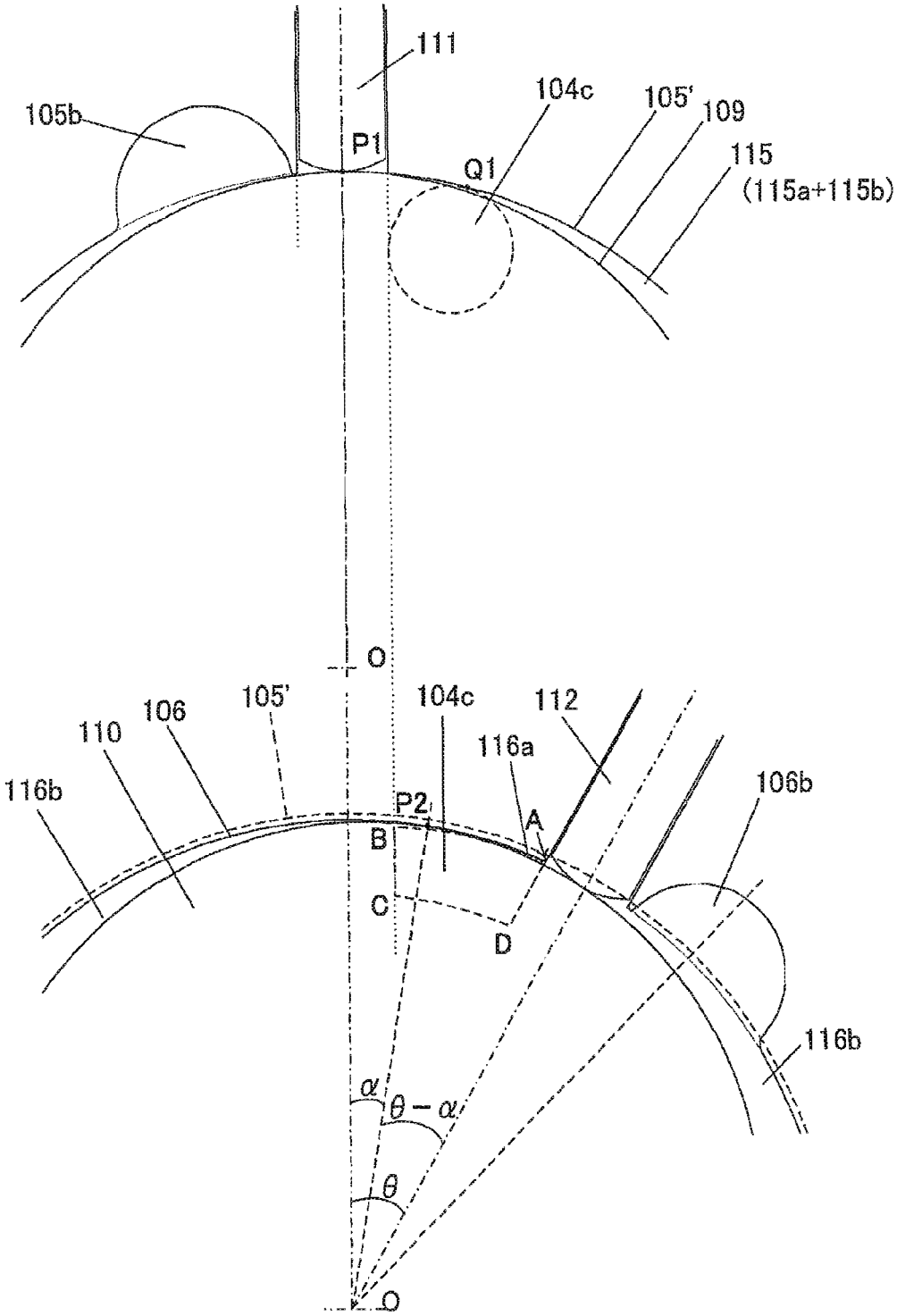
FIG. 8B is an operation explanatory view that follows FIG. 8A.
Figure 8C:
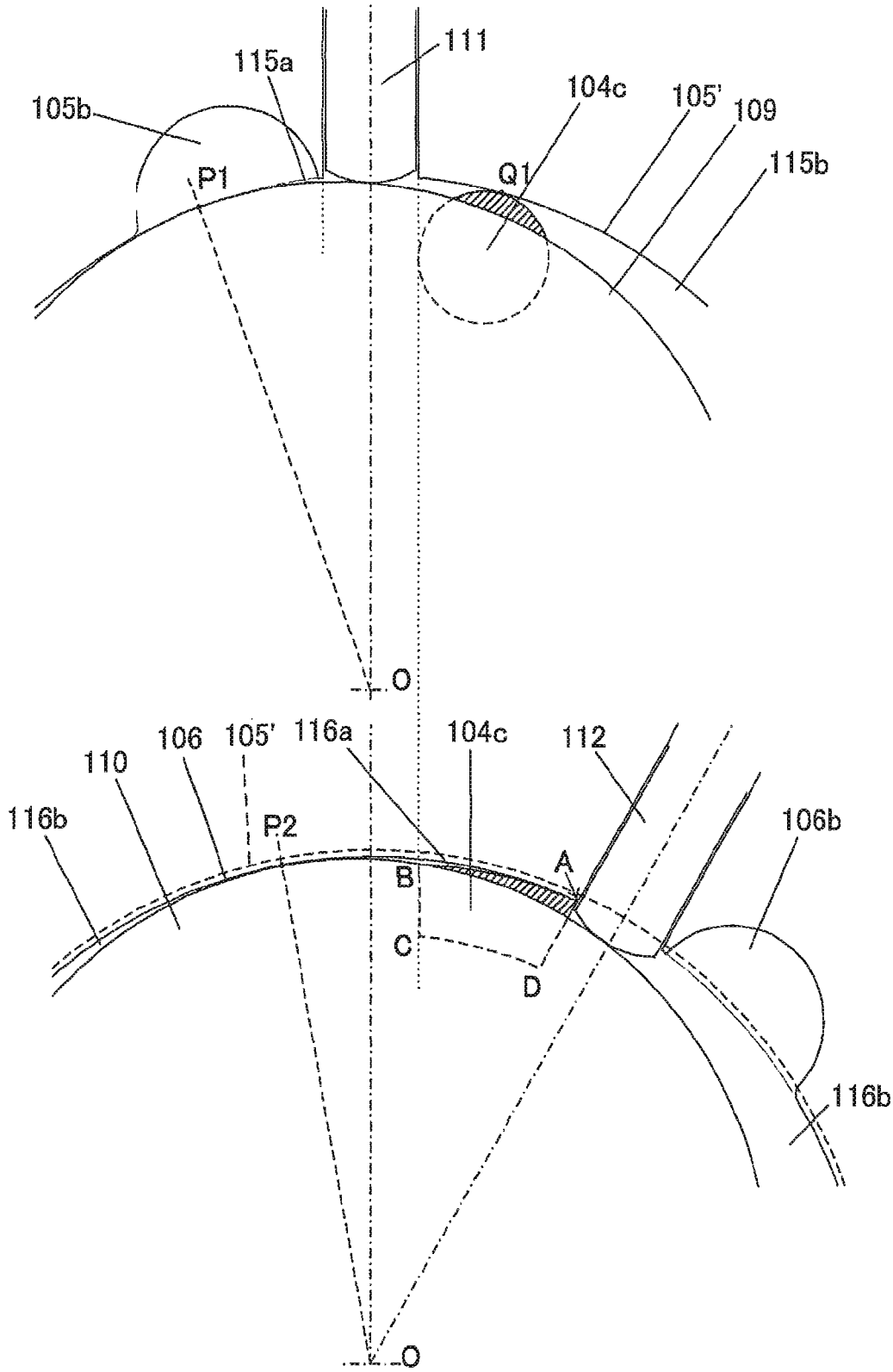
FIG. 8C is an operation explanatory view that follows FIG. 8B.
Figure 8D:
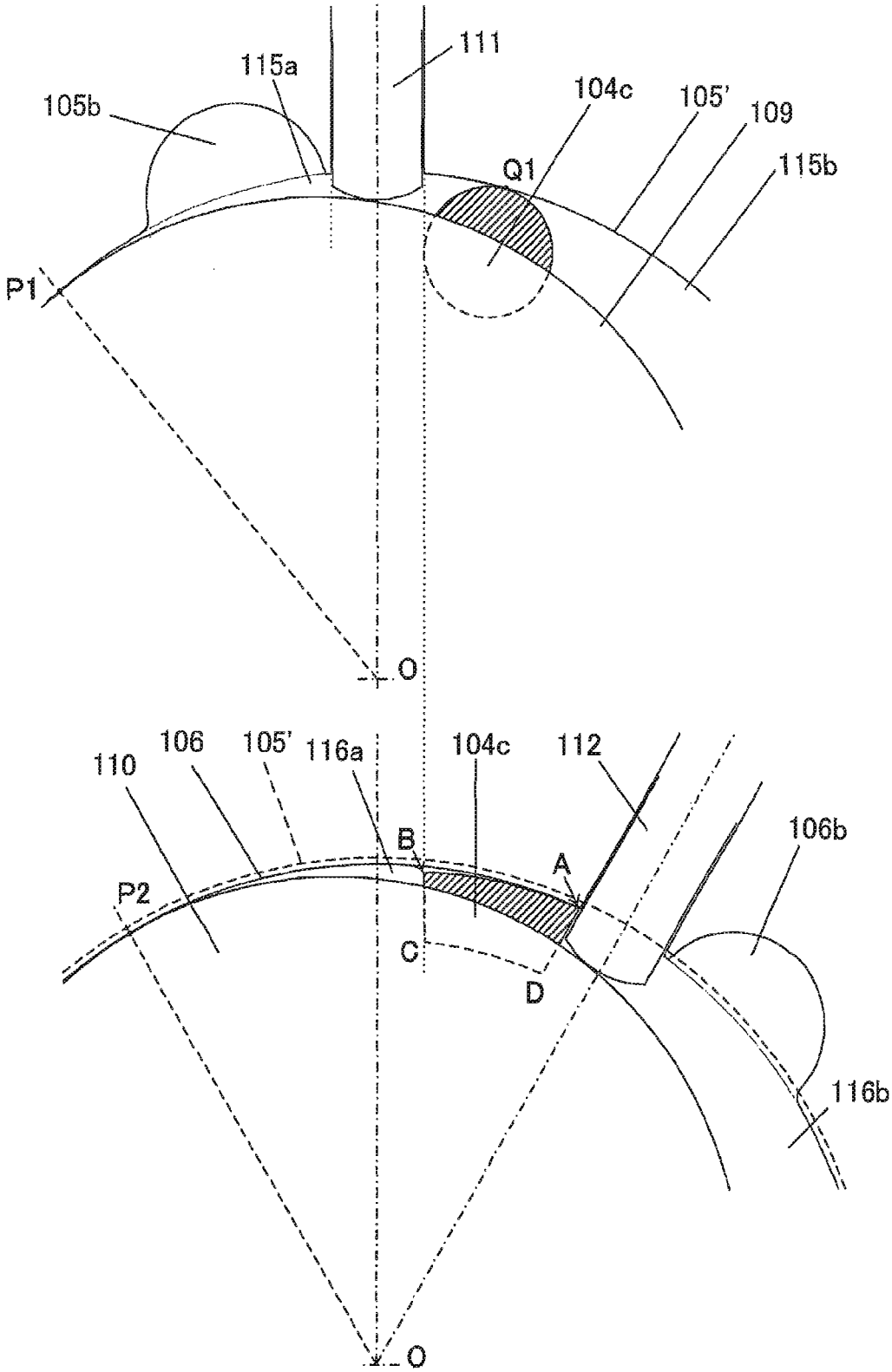
FIG. 8D is an operation explanatory view that follows FIG. 8C.

FIG. 7C illustrates the moment at which the shaft 103 has rotated 20° from FIG. 7B, and FIG. 7D illustrates the moment at which the shaft 103 has rotated 20° from FIG. 7C. The communication hole 104*d* is in communication with both the first discharge side space 115*b* of the first cylinder 105 and the second suction side space 116*a* of the second cylinder 106, and the communication area is increasing. Expansion of the refrigerant starts from the time point at which the contact point P1 between the first cylinder 105 and the first piston 109 reaches an edge of the suction port 105*b* in the direction of rotation of the shaft 103.

As will be appreciated from FIGS. 7A to 7D, the period in which the refrigerant can blow through from the suction port 105*b* to the discharge port 106*b* does not exist in the present embodiment as well.

Fifth Embodiment

Although the first through fourth embodiments have a configuration in which the first and second cylinders have an equal inner diameter and also the first and second pistons have an equal outer diameter, such a configuration is not essential to the present invention. As illustrated in FIGS. 8A to 8D, the present embodiment employs a first cylinder 105' with a larger diameter and a second cylinder 106 with a smaller diameter. Since the first piston 109 and the second piston 110 have an equal outer diameter, the height of the second cylinder 106 is set to be greater than the height of the first cylinder 105' so that the displacement of the second cylinder 106 side is greater.

The present embodiment has the same configuration as the third embodiment except that the inner diameters of the cylinders are different. Specifically, FIGS. 8A to 8D correspond to FIGS. 6A to 6D. The period in which the refrigerant can blow through from the suction port 105*b* to the discharge port 106*b* does not exist in the present embodiment as well.

It is also possible that the inner diameter of the second cylinder may be made greater than the inner diameter of the first cylinder, or that the outer diameters of the pistons may be varied. Under certain circumstances, the height of the first cylinder and the height of the second cylinder may be the same.

INDUSTRIAL APPLICABILITY

The two-stage rotary expander 100 according to the present embodiments is useful as a power recovery apparatus for recovering the energy of expansion from a compressible fluid such as a refrigerant in a refrigeration cycle.

Figure 9:
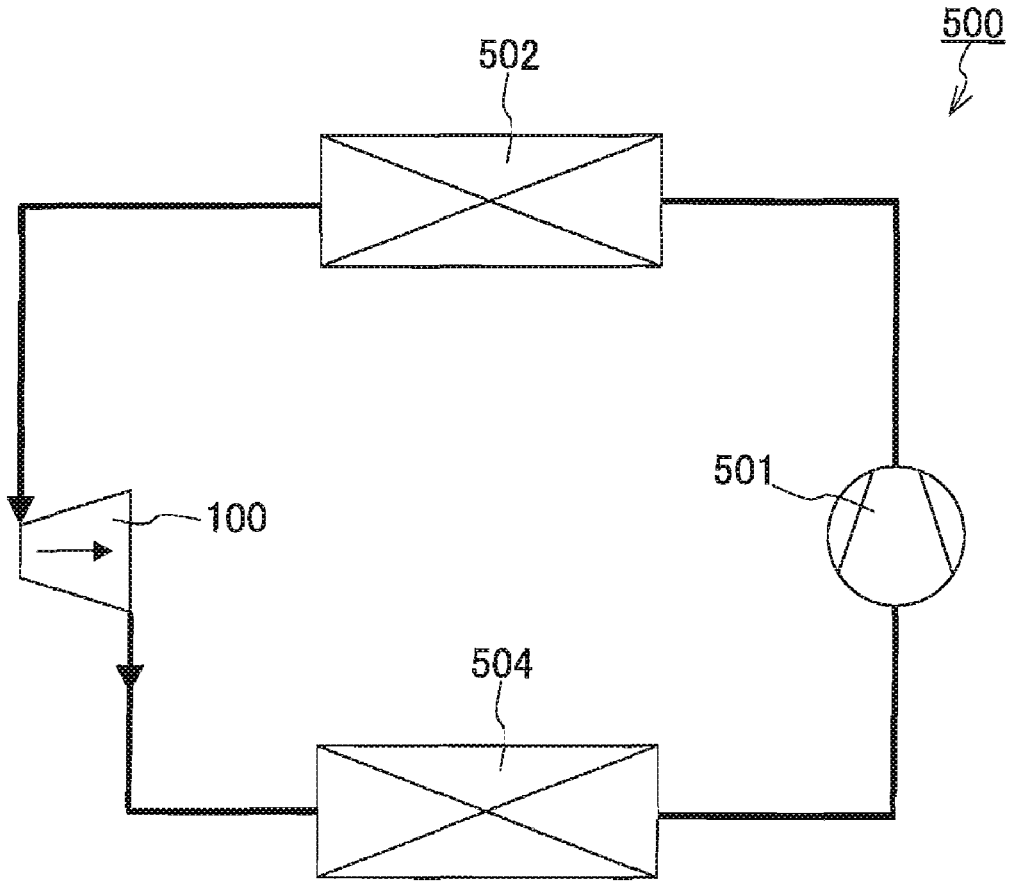
FIG. 9 is a block diagram illustrating a refrigeration cycle apparatus that uses the expander shown in FIG. 1.
Figure 10A:
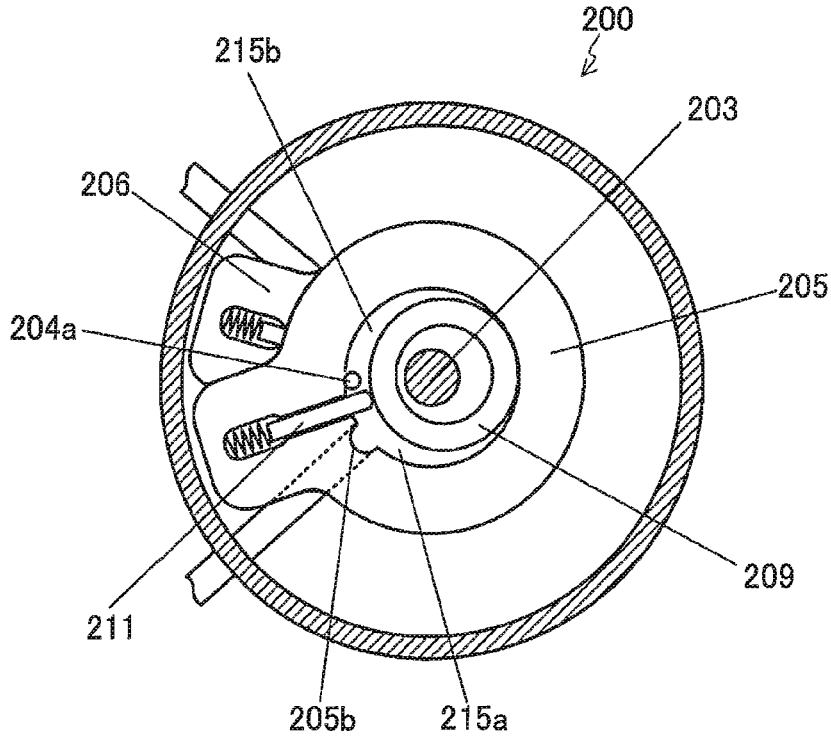
FIG. 10A is a horizontal cross-sectional view of a conventional two-stage rotary expander.
Figure 10B:
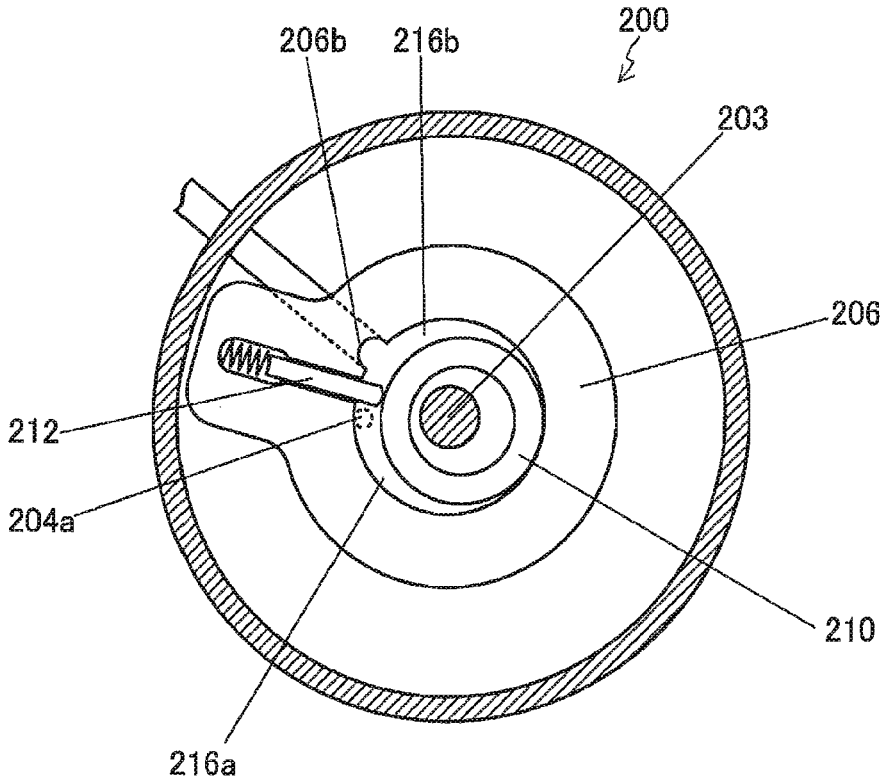
FIG. 10B is also a horizontal cross-sectional view of the conventional two-stage rotary expander.
Figure 11A:
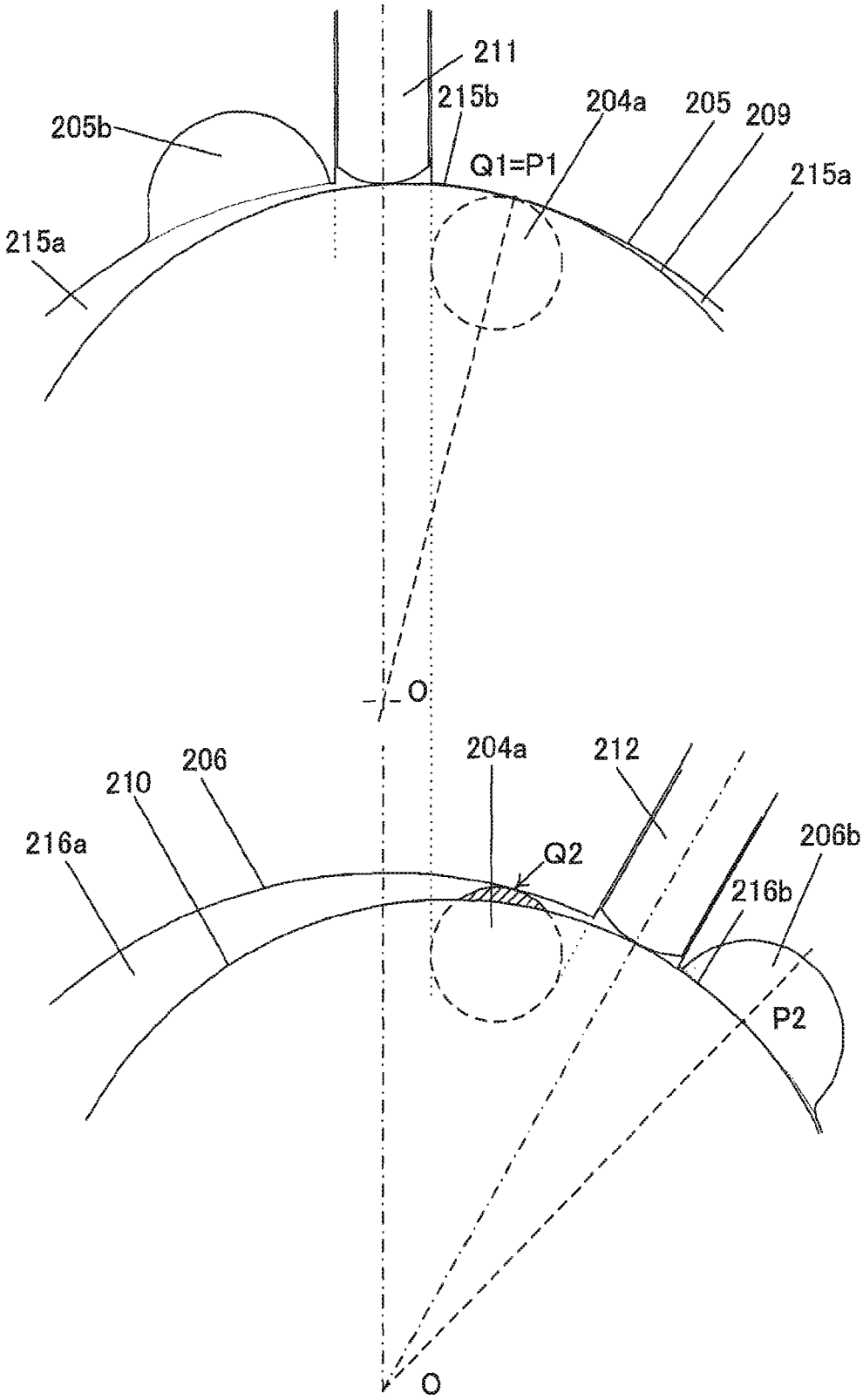
FIG. 11A is an operation explanatory view for clarifying problems of the conventional two-stage rotary expander.
Figure 11B:
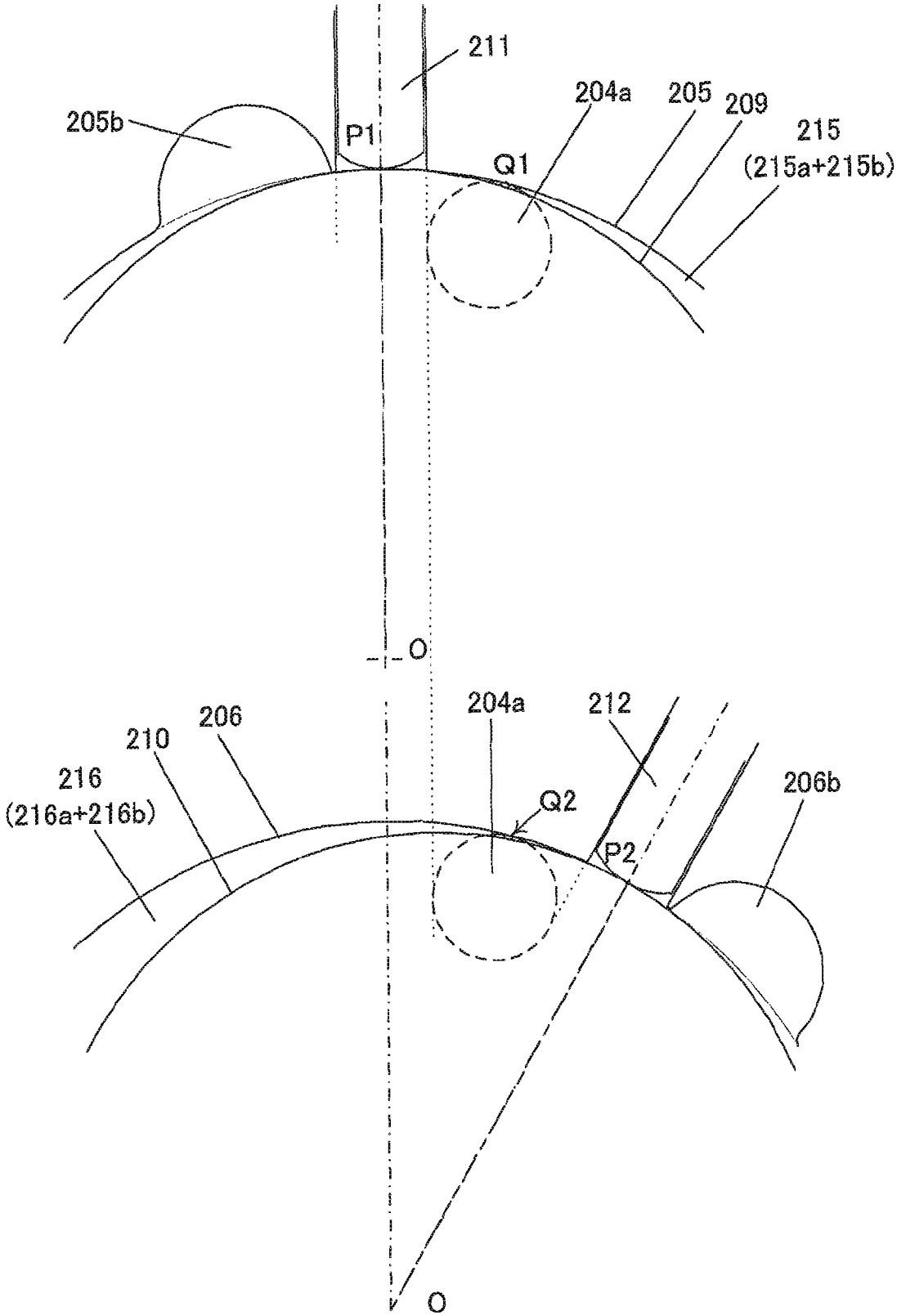
FIG. 11B is an operation explanatory view that follows FIG. 11A.
Figure 11C:
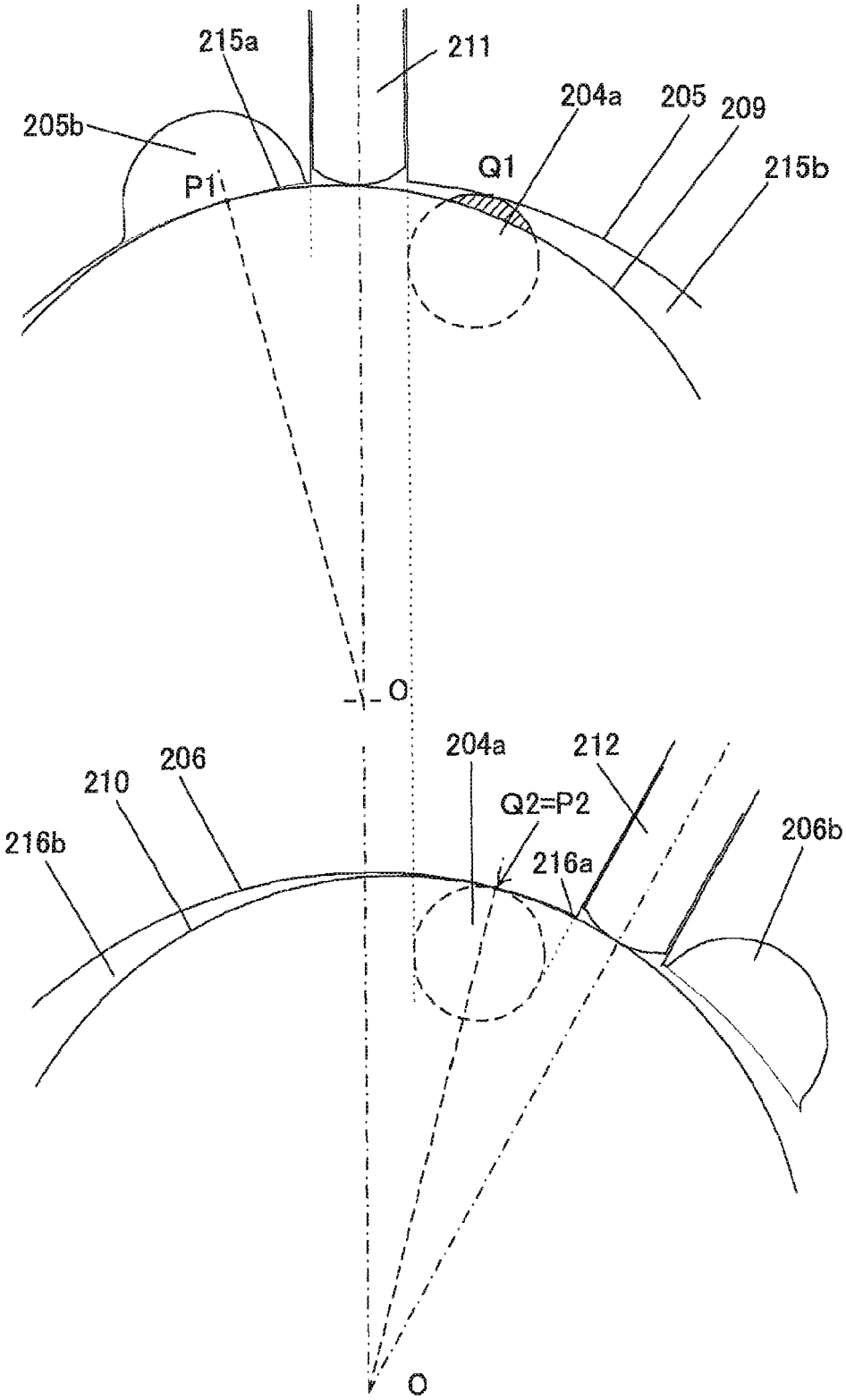
FIG. 11C is an operation explanatory view that follows FIG. 11B.
Figure 11D:
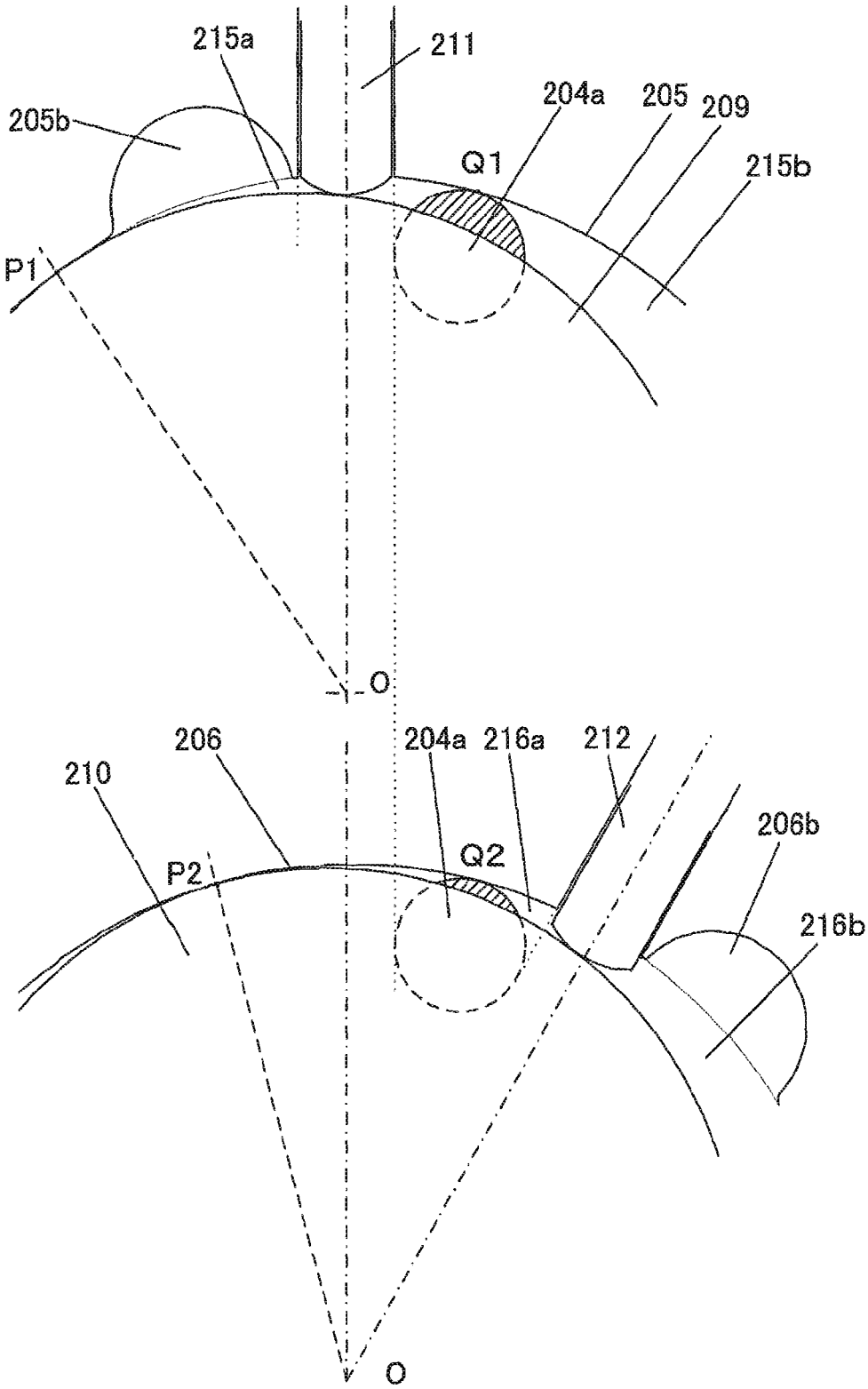
FIG. 11D is an operation explanatory view that follows FIG. 11C.

The two-stage rotary expander 100 may be applied to, for example, a refrigeration cycle apparatus, which constitutes a primary part of an air conditioner or a water heater. As illustrated in FIG. 9, a refrigeration cycle apparatus 500 includes: a compressor 501 for compressing a refrigerant; a radiator 502 for cooling the refrigerant compressed by the compressor 501; a two-stage rotary expander 100 for expanding the refrigerant that has been cooled at the radiator 502; and an evaporator 504 for evaporating the refrigerant expanded by the two-stage rotary expander 100. The two-stage rotary expander 100 recovers the energy of expansion of the refrigerant in the form of electric power. The recovered electric power is used as a part of the electric power necessary for driving the compressor 501. It is also possible to employ an embodiment in which the energy of expansion of the refrigerant is not converted into electric power but is transferred directly to the compressor 501 in the form of mechanical power, by coupling a shaft of the expander 2 and a shaft of the compressor 501 to each other.

It should be noted that the present specification has illustrated rotary-type fluid machines (expanders) containing two-stage cylinders, but the advantageous effects of the present invention can be obtained likewise even when the number of cylinder stages is three or greater.

The invention claimed is:

1. A multi-stage rotary-type fluid machine comprising:
- a first cylinder;
- a shaft penetrating the first cylinder;
- a first piston fitted to the shaft and rotating eccentrically in the first cylinder;
- a second cylinder disposed concentrically with the first cylinder so as to share the shaft with the first cylinder;
- a second piston fitted to the shaft and rotating eccentrically in the second cylinder;
- a first partitioning member fitted into a first groove formed in the first cylinder, for partitioning a space between the first cylinder and the first piston into a first suction side space and a first discharge side space;
- a second partitioning member fitted into a second groove formed in the second cylinder, for partitioning a space between the second cylinder and the second piston into a second suction side space and a second discharge side space;
- an intermediate plate having a communication hole for allowing communication between the first discharge side space and the second suction side space to form a single working chamber, the intermediate plate partitioning the first cylinder and the second cylinder;
- a suction port for drawing a working fluid into the first suction side space; and
- a discharge port for discharging the working fluid from the second discharge side space, wherein
- an opening shape and a location of the communication hole are set so that direct blow-through of the working fluid from the suction port to the discharge port cannot occur at any rotation angle of the shaft.

2. The multi-stage rotary-type fluid machine according to claim 1, wherein an entirety of an opening edge of the communication hole at the second cylinder side is located closer to the center of the shaft than an outer contour of the second piston at a moment at which the communication hole and the first suction side space start communication therebetween.

3. The multi-stage rotary-type fluid machine according to claim 1, wherein:
- in the first cylinder side, a location of an opening of the communication hole and a location of the suction port are set in such a manner that they are distributed to the left and right of the first partitioning member; and
- in the second cylinder side, a location of an opening of the communication hole and a location of the discharge port are set in such a manner that they are distributed to the left and right of the second partitioning member.

4. The multi-stage rotary-type fluid machine according to claim 3, wherein an opening shape and a location of the communication hole, and phases of the first piston and the second piston are set so that the communication hole, the second discharge side space of the second cylinder, and the discharge port are not in communication with each other during a period in which the suction port, the first suction side space of the first cylinder, and the communication hole are in communication with each other.

5. The multi-stage rotary-type fluid machine according to claim 1, wherein a section of an opening edge of the communication hole at the second cylinder side overlaps with a virtual circle having the same diameter as the second piston and being inscribed to the second cylinder.

6. The multi-stage rotary-type fluid machine according to claim 1, wherein a section of an opening edge of the communication hole at the second cylinder side is in a circular arc shape in accordance with an outer contour of the second piston that is at a moment at which communication between the communication hole and the first discharge side space is blocked.

7. The multi-stage rotary-type fluid machine according to claim 1, wherein an entirety of an opening edge of the communication hole at the second cylinder side is spaced apart from an inner circumferential surface of the second cylinder.

8. The multi-stage rotary-type fluid machine according to claim 1, wherein the communication hole includes a counter boring formed in the intermediate plate, and an opening edge of the communication hole at the second cylinder side is formed by the counter boring.

9. The multi-stage rotary-type fluid machine according to claim 1, wherein:

the first partitioning member and the second partitioning member are disposed so as to be staggered from each other at a predetermined angle around a rotation axis of the shaft; and the communication hole is formed in the intermediate plate within an angular range between the first partitioning member and the second partitioning member.

10. The multi-stage rotary-type fluid machine according to claim 1, wherein:

the first partitioning member and the second partitioning member are disposed at angular positions that are in agreement with each other around a rotation axis of the shaft; and the communication hole is formed in the intermediate plate so as to cross a plane containing longitudinal center lines of the first partitioning member and the second partitioning member and a rotation axis of the shaft and to extend in a slanted direction with respect to the rotation axis of the shaft.

11. The multi-stage rotary-type fluid machine according to claim 1, wherein a section of an opening edge of the communication hole at the second cylinder side is along a range of motion of the second partitioning member.

12. A refrigeration cycle apparatus comprising:

a compressor for compressing a refrigerant;

a radiator for cooling the refrigerant compressed by the compressor;

an expander for expanding the refrigerant cooled by the radiator; and an evaporator for evaporating the refrigerant expanded by the expander, wherein the expander comprises a multi-stage rotary type fluid machine according to claim 1.

* * * * *